US011974637B2

(12) United States Patent
MacLeod et al.

(10) Patent No.: US 11,974,637 B2
(45) Date of Patent: May 7, 2024

(54) BOOTS WITH FIT ADJUSTMENT SYSTEMS

(71) Applicant: Ariat International, Inc., San Leandro, CA (US)

(72) Inventors: Lars Erik MacLeod, South Lake Tahoe, CA (US); Jake Lawrence Rivas, Oakland, CA (US)

(73) Assignee: Ariat International, Inc., San Leandro, CA (US)

( * ) Notice: Subject to any disclaimer, the term of this patent is extended or adjusted under 35 U.S.C. 154(b) by 21 days.

(21) Appl. No.: 17/678,946

(22) Filed: Feb. 23, 2022

(65) Prior Publication Data

US 2022/0273075 A1 Sep. 1, 2022

Related U.S. Application Data

(60) Provisional application No. 63/155,034, filed on Mar. 1, 2021.

(51) Int. Cl.
*A43C 11/00* (2006.01)
*A43C 11/16* (2006.01)

(52) U.S. Cl.
CPC ..... *A43C 11/008* (2013.01); *A43C 11/165* (2013.01)

(58) Field of Classification Search
CPC ..... A43C 11/008; A43C 11/165; A43B 19/00
See application file for complete search history.

(56) References Cited

U.S. PATENT DOCUMENTS 3,522,668 A 8/1970 Fesl
4,030,215 A 6/1977 Vogel
4,539,763 A 9/1985 Walkhoff
4,660,303 A 4/1987 Courvoisier et al.
4,719,710 A * 1/1988 Pozzobon ..... A43C 11/16 36/117.7
4,811,503 A * 3/1989 Iwama ..... A43B 5/0447 36/118.1
4,937,953 A * 7/1990 Walkhoff ..... A43B 5/0449 36/117.7
5,319,868 A * 6/1994 Hallenbeck ..... A43C 11/00 36/50.1

(Continued)

FOREIGN PATENT DOCUMENTS

WO WO 2006/014940 A1 2/2006
WO WO 2006/074067 A1 7/2006

*Primary Examiner* — Bao-Thieu L Nguyen

(74) *Attorney, Agent, or Firm* — Kolitch Romano Dascenzo Gates LLC; David S. D'Ascenzo

(57) ABSTRACT

Boots with fit adjustment systems that are configured to selectively adjust a fit of the boot on the wearer's foot by engaging the foot with more force and/or across a greater surface area relative to a pull-on boot that lacks the fit adjustment system. The fit adjustment system may adjust the fit of the boot without adjusting the external dimensions of the boot. The fit adjustment system includes an instep pad that is positioned interior of the external surface of the upper within an instep region of the boot, a lace that is coupled to the instep pad, and a lace adjustment mechanism. The lace adjustment mechanism includes a lace lock that selectively defines an adjustment length of the lace. Actuating the lace adjustment mechanism to reduce the adjustment length exerts a tightening force on the instep pad and draws the instep pad toward a heel region of the boot.

18 Claims, 11 Drawing Sheets

(56) References Cited

U.S. PATENT DOCUMENTS 5,381,609 A * 1/1995 Hieblinger ..... A43C 11/00 36/50.1
5,463,822 A * 11/1995 Miller ..... A43C 11/165 36/50.1
5,502,902 A * 4/1996 Sussmann ..... A43C 11/00 24/714.7
5,511,325 A * 4/1996 Hieblinger ..... A43C 11/165 36/105
5,704,138 A 1/1998 Donnadieu
5,791,021 A * 8/1998 James ..... A43C 11/1406 24/712.2
6,267,390 B1 * 7/2001 Maravetz ..... A43C 1/06 36/119.1
6,416,074 B1 * 7/2002 Maravetz ..... A43C 11/165 36/119.1
6,792,702 B2 9/2004 Borsoi et al.
6,938,913 B2 * 9/2005 Elkington ..... A63C 10/06 280/607
6,945,543 B2 * 9/2005 De Bortoli ..... A63C 10/06 280/619
6,978,558 B2 * 12/2005 Grella ..... A43B 5/0401 36/50.1
6,993,859 B2 2/2006 Martin et al.
7,065,906 B2 * 6/2006 Jones ..... A43C 11/1406 36/50.1
7,146,752 B2 12/2006 Pasternak et al.
7,568,719 B2 * 8/2009 Sauter ..... A63C 10/04 280/634
7,591,050 B2 9/2009 Hammerslag
7,596,889 B2 10/2009 Pasternak et al.
7,818,897 B2 10/2010 Geer
7,818,899 B2 10/2010 Dinndorf et al.
8,087,188 B2 * 1/2012 Labbe ..... A43C 11/008 24/712
8,375,603 B2 2/2013 Dinndorf et al.
8,381,362 B2 2/2013 Hammerslag et al.
8,468,657 B2 6/2013 Soderberg et al.
8,621,765 B2 1/2014 Geer et al.
8,782,927 B2 7/2014 Dinndorf et al.
8,806,778 B2 8/2014 Kishino
8,857,077 B2 10/2014 Kahatsu et al.
8,858,482 B2 10/2014 Ingimundarson et al.
8,984,719 B2 3/2015 Soderberg et al.
9,144,263 B2 * 9/2015 Elder ..... A43B 23/0245
9,220,318 B2 * 12/2015 James ..... A43C 11/16
9,439,477 B2 9/2016 Neiley
9,480,299 B2 11/2016 Dinndorf et al.
9,629,416 B2 4/2017 Rackiewicz et al.
9,681,705 B2 6/2017 Trudel et al.
9,706,814 B2 7/2017 Converse et al.
9,770,070 B2 9/2017 Cotterman et al.
10,102,566 B2 10/2018 Joshi et al.
10,219,583 B2 3/2019 Dallas
10,271,616 B2 * 4/2019 Labbe ..... A43C 11/165
10,492,568 B2 12/2019 Burns et al.
11,324,284 B2 * 5/2022 Beers ..... A43C 11/008
2004/0226190 A1 11/2004 Elkington et al.
2005/0022427 A1 * 2/2005 Kerns ..... A43C 11/16 36/50.1
2006/0156517 A1 7/2006 Hammerslag et al.
2006/0191164 A1 * 8/2006 Dinndorf ..... A43C 1/06 36/50.1
2006/0254093 A1 11/2006 Fuchslocher et al.
2008/0168685 A1 7/2008 Kim et al.
2011/0078924 A1 4/2011 Rackiewicz et al.
2012/0004587 A1 1/2012 Nickel et al.
2012/0144700 A1 6/2012 Zhao et al.
2013/0269219 A1 10/2013 Burns et al.
2014/0123449 A1 5/2014 Soderberg et al.
2014/0202039 A1 7/2014 Geer et al.
2014/0259783 A1 9/2014 Dinndorf et al.
2015/0089779 A1 4/2015 Lawrence et al.
2015/0335098 A1 * 11/2015 Monroy ..... A43C 17/02 36/69
2016/0058127 A1 3/2016 Burns et al.
2016/0135542 A9 * 5/2016 Monroy ..... A43C 17/06 36/69
2017/0042291 A1 2/2017 Dinndorf et al.
2017/0224056 A1 * 8/2017 Midorikawa ..... A43C 11/165
2017/0265590 A1 9/2017 Burns et al.
2020/0046080 A1 2/2020 Burns et al.
2022/0007793 A1 * 1/2022 Bidal ..... A43C 1/003
2022/0279900 A1 * 9/2022 Vladika ..... A43B 5/0401
2023/0189936 A1 * 6/2023 Siegismund ..... A43C 11/20 36/50.1

* cited by examiner

BOOTS WITH FIT ADJUSTMENT SYSTEMS

RELATED APPLICATION

This application claims priority to U.S. Provisional Patent Application No. 63/155,034, which was filed on Mar. 1, 2021, and the complete disclosure of which is hereby incorporated by reference.

FIELD OF THE DISCLOSURE

The present disclosure relates generally to footwear, and more specifically to boots with fit adjustment systems.

BACKGROUND OF THE DISCLOSURE

Some examples of conventional boots, such as pull-on boots, are free of mechanical and/or adjustable fasteners, such as tied laces, buckles, zippers, etc., for adjusting a fit of the boot upon a wearer's foot. In such examples, sizing the upper such that the wearer's foot may be inserted into and removed from the boot may result in a somewhat loose engagement between the upper and the wearer's foot when the boot is worn by the wearer. In particular, in such examples, the boot may shift relative to the wearer's foot, such as relative to a heel of the wearer's foot, which may render the boot undesirable or inappropriate for applications in which secure engagement between the boot and the wearer's foot is desired and/or required. Accordingly, there exists a need for fit adjustment systems for pull-on boots and for pull-on boots with such fit adjustment systems.

SUMMARY OF THE DISCLOSURE

Boots with fit adjustment systems that are configured to selectively adjust a fit of the boot on the wearer's foot by engaging the foot with more force and/or across a greater surface area relative to a pull-on boot that lacks the fit adjustment system. The fit adjustment system may adjust the fit of the boot without adjusting the external dimensions of the boot. The fit adjustment system includes an instep pad that is positioned interior of the external surface of the boot's upper within an instep region of the boot, a lace that is coupled to the instep pad, and a lace adjustment mechanism. The lace adjustment mechanism includes a lace lock that selectively defines an adjustment length of the lace. Actuating the lace adjustment mechanism to reduce the adjustment length exerts a tightening force on the instep pad and draws the instep pad toward a heel region of the boot. Actuating the lace adjustment mechanism to permit increasing the adjustment length of the lace permits the instep pad to be moved away from the heel region of the boot. The boot may be a pull-on boot that is free of one or more of mechanical fasteners, adjustable fasteners, tied laces, buckles, zippers, and other mechanisms for constricting the external surface of the boot's upper.

DETAILED DESCRIPTION AND BEST MODE OF THE DISCLOSURE

FIGS. 1-15 provide examples of boots 100 that include a fit adjustment system 200 according to the present disclosure. Elements that serve a similar, or at least substantially similar, purpose are labeled with like numbers in FIGS. 1-15, and these elements may not be discussed in detail herein with reference to each of FIGS. 1-15. Similarly, all elements may not be labeled in FIGS. 1-15, but reference numbers associated therewith may be utilized herein for consistency. Elements, components, and/or features that are discussed herein with reference to FIGS. 1-15 may be included in and/or utilized with the subject matter of FIGS. 1-15 without departing from the scope of the present disclosure. In general, elements that are likely to be included in a particular embodiment are illustrated in solid lines, while elements that are optional are illustrated in dashed (e.g., broken) lines. However, elements that are shown in solid lines may not be essential to all embodiments and, in some embodiments, may be omitted without departing from the scope of the present disclosure. Additionally, in some instances, elements that are concealed from view are illustrated in and/or indicated with dashed (e.g., broken) lines.

Figure 1:
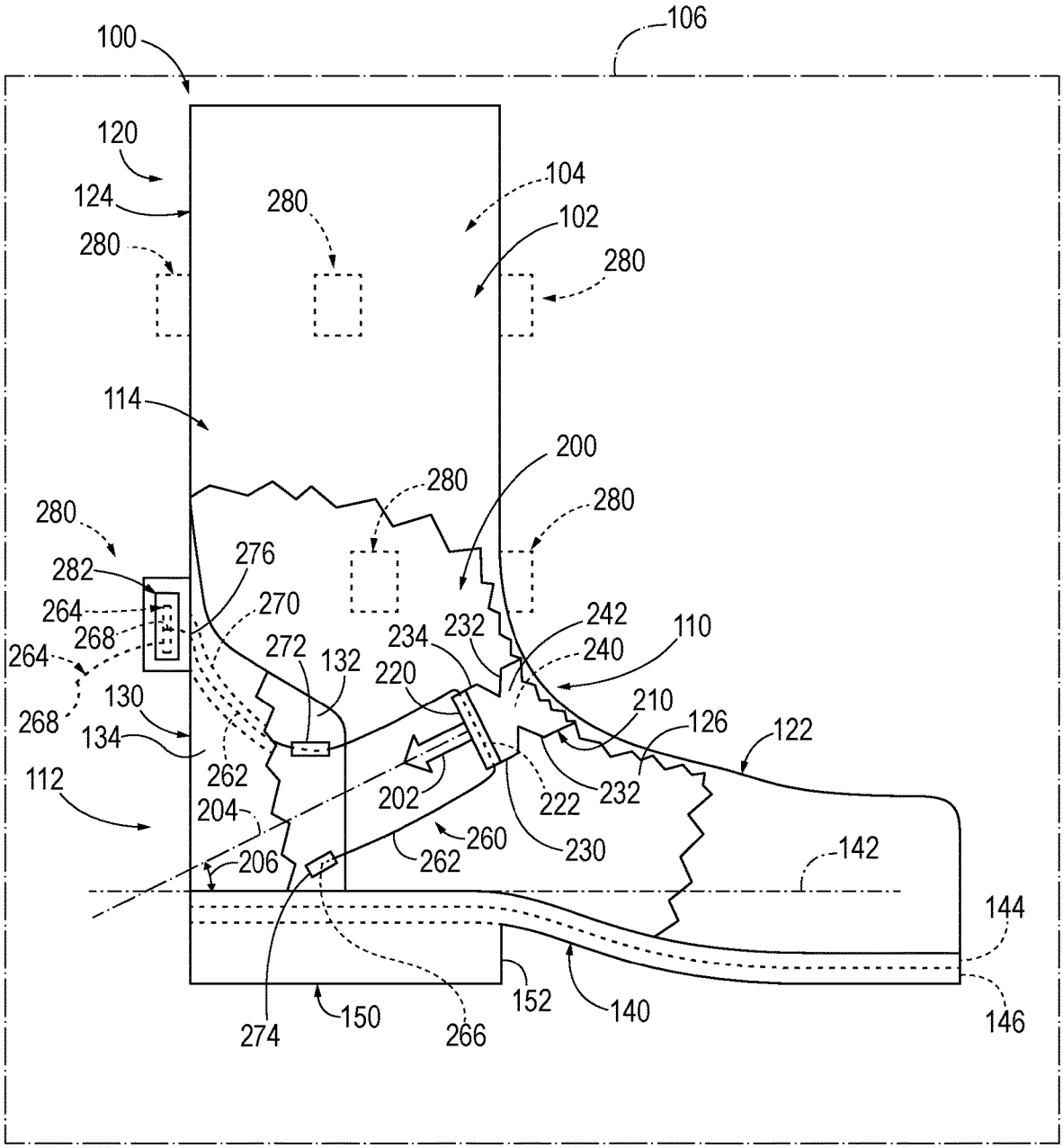
FIG. 1 is a schematic partially cutaway medial side elevation view representing examples of boots according to the present disclosure.
Figure 2:
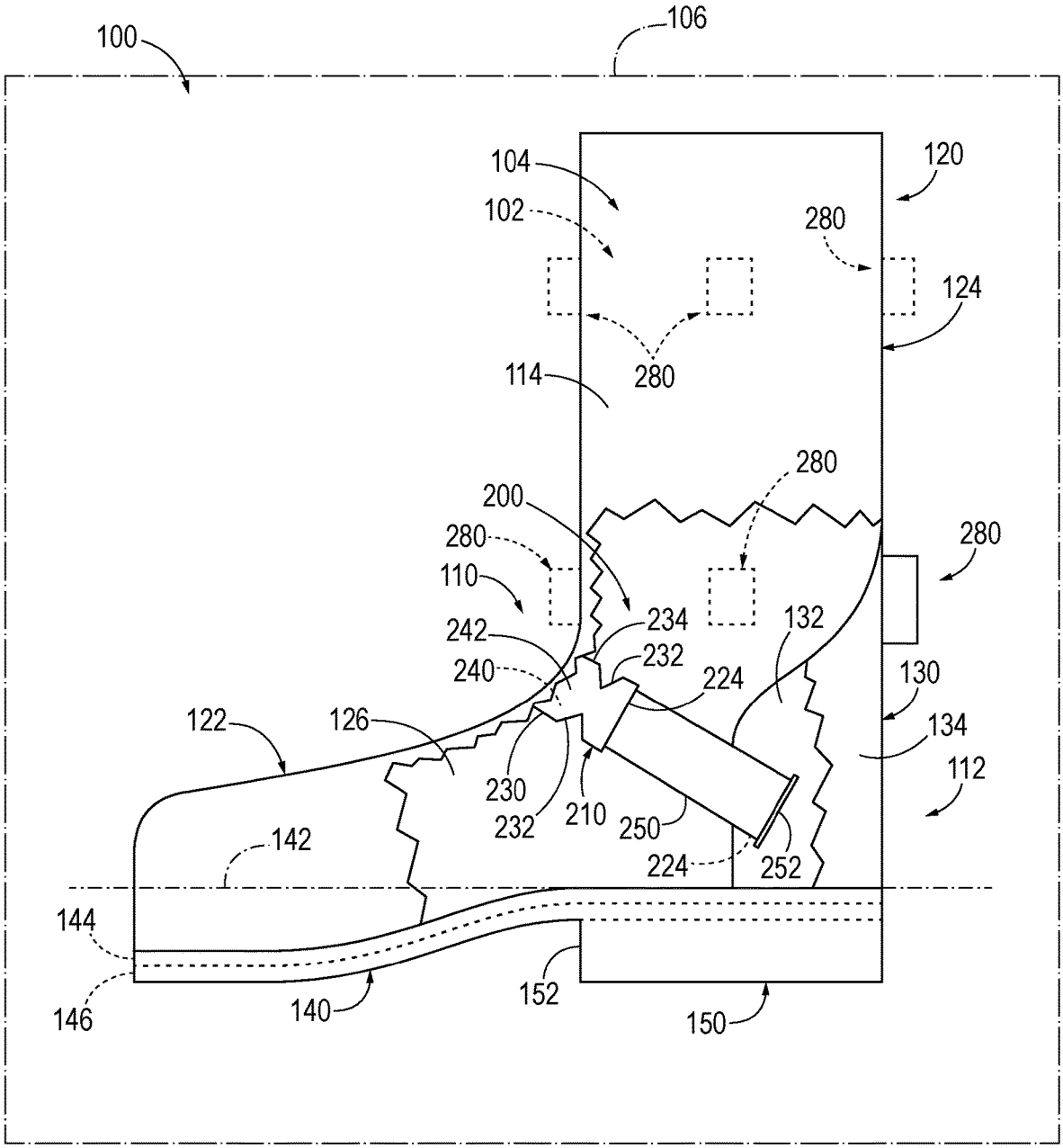
FIG. 2 is a schematic partially cutaway lateral side elevation view representing examples of boots according to the present disclosure.

FIGS. 1-2 provide schematic illustrations of examples of boots 100 that include fit adjustment systems 200 according to the present disclosure, while FIGS. 3-15 illustrate more specific examples of boots 100 and/or of portions thereof. As schematically illustrated in FIGS. 1-2, a boot 100 includes an upper 120 that is configured to receive a wearer's foot when the boot is worn by the wearer (i.e., when the boot is donned on the wearer's foot). Boot 100 also includes a sole assembly 140 that is operatively coupled to the upper and configured to contact a ground surface on which the wearer is striding. Sole assembly 140 additionally or alternatively may be referred to as a sole 140. As schematically illustrated in FIGS. 1-2, upper 120 includes a shell 122 that is configured to extend around at least a portion of the wearer's foot when boot 100 is worn, or donned, by the wearer. Upper 120 additionally includes a shaft 124 that is operatively coupled to the shell and configured to extend around at least a portion of the wearer's leg when the boot is worn by the wearer. For example, shell 122 and sole assembly 140 may surround at least a substantial portion, if not all, of a wearer's foot, while shaft 124 may extend around at least a lower portion of a wearer's leg, such as proximate the Achilles region, above the Achilles region, proximate the mid-calf region, above the mid-calf region, and/or proximate the knee region of the wearer's lower leg.

As further schematically illustrated in FIGS. 1-2, upper 120 includes an external surface 114 such that shell 122 and shaft 124 each define a portion of the external surface. Stated differently, as used herein, external surface 114 is intended to refer to any surface of upper 120 that is visible and/or externally accessible while the wearer wears boot 100.

Sole assembly 140 may include any of a variety of components, such as may be characteristic of boots 100. For example, and as schematically illustrated in FIGS. 1-2 and less schematically illustrated in FIGS. 6-12, sole assembly 140 may include an insole 144 (shown in FIGS. 1-2) that is configured to face and/or contact the wearer's foot when the boot is worn by the wearer, an outsole 146 that is configured to contact a ground surface on which the wearer is striding, and/or a heel assembly 150 that is configured to be positioned underneath a heel of the wearer's foot when the boot is worn by the wearer. In some examples, heel assembly 150 projects away from another portion of sole assembly 140. In particular, in some such examples, and as schematically illustrated in FIGS. 1-2 and less schematically illustrated at least in FIGS. 6 and 9-12, heel assembly 150 includes a heel breast 152 that faces toward at least a portion of sole assembly 140 and/or outsole 146 that extends forward of the heel assembly. Additionally or alternatively, in some examples, heel assembly 150 is an external heel assembly that is operatively coupled to and/or projects from the outsole. However, this is not required of all examples of sole assembly 140, and it additionally is within the scope of the present disclosure that outsole 146 at least partially defines heel assembly 150. In such examples, heel assembly 150 may be described as being an integrated heel assembly. Heel assembly 150 additionally or alternatively may be referred to as heel 150.

As used herein, positional terms such as "top," "above," "bottom," "below," "forward," "rearward," and the like generally refer to a configuration of boot 100 in which sole assembly 140 rests upon a level horizontal ground surface such that shaft 124 extends vertically upward. In this manner, upper 120 may be described as being positioned above sole assembly 140. Additionally, a portion of boot 100 that is configured to receive toes of the wearer's foot may be described as being positioned forward of a portion of boot 100 that is configured to receive the heel of the wearer's foot. However, such positional terms are not limiting, and it is additionally within the scope of the present disclosure that boot 100 may have any appropriate orientation relative to a level ground surface, and/or that a forward direction may be defined in any suitable manner.

As schematically illustrated in FIGS. 1-2, boot 100 includes fit adjustment system 200 for selectively adjusting a fit of the boot on the wearer's foot when the boot is worn by the wearer. For example, fit adjustment system 200 may be configured to selectively secure the wearer's foot within the boot, such as by engaging the foot with more force and/or across a greater surface area relative to a pull-on boot that lacks fit adjustment system 200. In some examples, the fit adjustment system may constrict or permit enlargement of an internal perimeter of a portion of the boot's upper, such as its shell and/or shaft, to more closely conform to the wearer's foot and/or leg that is received within the boot when the boot is donned by the wearer. In some examples, the fit adjustment system may constrict or permit enlargement of the internal portion of the boot's upper without constricting or reducing the external dimensions and/or external perimeter of the external surface of the boot's upper.

In some examples, boot 100 is a pull-on boot that (apart from fit adjustment system 200) is free of mechanical and/or adjustable fasteners, such as tied laces, buckles, zippers, etc., for adjusting a fit of the boot upon the wearer's foot by constricting the external dimensions of the boot's upper and/or reducing the perimeter of the external surface of the boot's upper. In such examples, sizing the upper such that the wearer's foot may be inserted into and removed from the boot may result in a somewhat loose engagement between the upper and the wearer's foot when the boot is worn by the wearer. In particular, in such examples, the boot may shift relative to the wearer's foot, such as relative to a heel of the wearer's foot, which may render the boot undesirable and/or inappropriate for applications in which secure engagement between the boot and the wearer's foot is desired and/or required. However, by including fit adjustment system 200, the fit of the boot may be selectively adjusted to more positively secure the wearer's foot within the boot. As discussed, fit adjustment system 200 may do so without constricting or otherwise adjusting the dimensions of the external surface of the boot's upper.

In some examples, and as schematically illustrated in FIGS. 1-2 and less schematically illustrated in FIGS. 6-12, upper 120 includes a heel counter 130 positioned in a heel region 112 of boot 100 and configured to reinforce the heel region, such as by enhancing a rigidity of the heel region. In particular, as used herein, heel region 112 may refer to a portion of boot 100 (e.g., of upper 120 and/or of sole assembly 140) that extends around at least a portion of, and optionally all of, the heel of the wearer's foot when the boot is worn by the wearer. Additionally or alternatively, heel region 112 may include the region of the boot bounded by the boot's heel assembly 150 and/or heel counter 130. The heel region additionally or alternatively may be referred to as a heel pocket that is defined by the heel counter and the portion of the sole assembly above heel assembly 150. In some examples, heel counter 130 includes lateral, posterior, and medial regions that extend above heel assembly 150 and that are free from notches or cutouts designed to promote movement or construction of these regions toward each other upon actuation of the lace adjustment mechanism of fit adjustment system 200.

Figure 6:
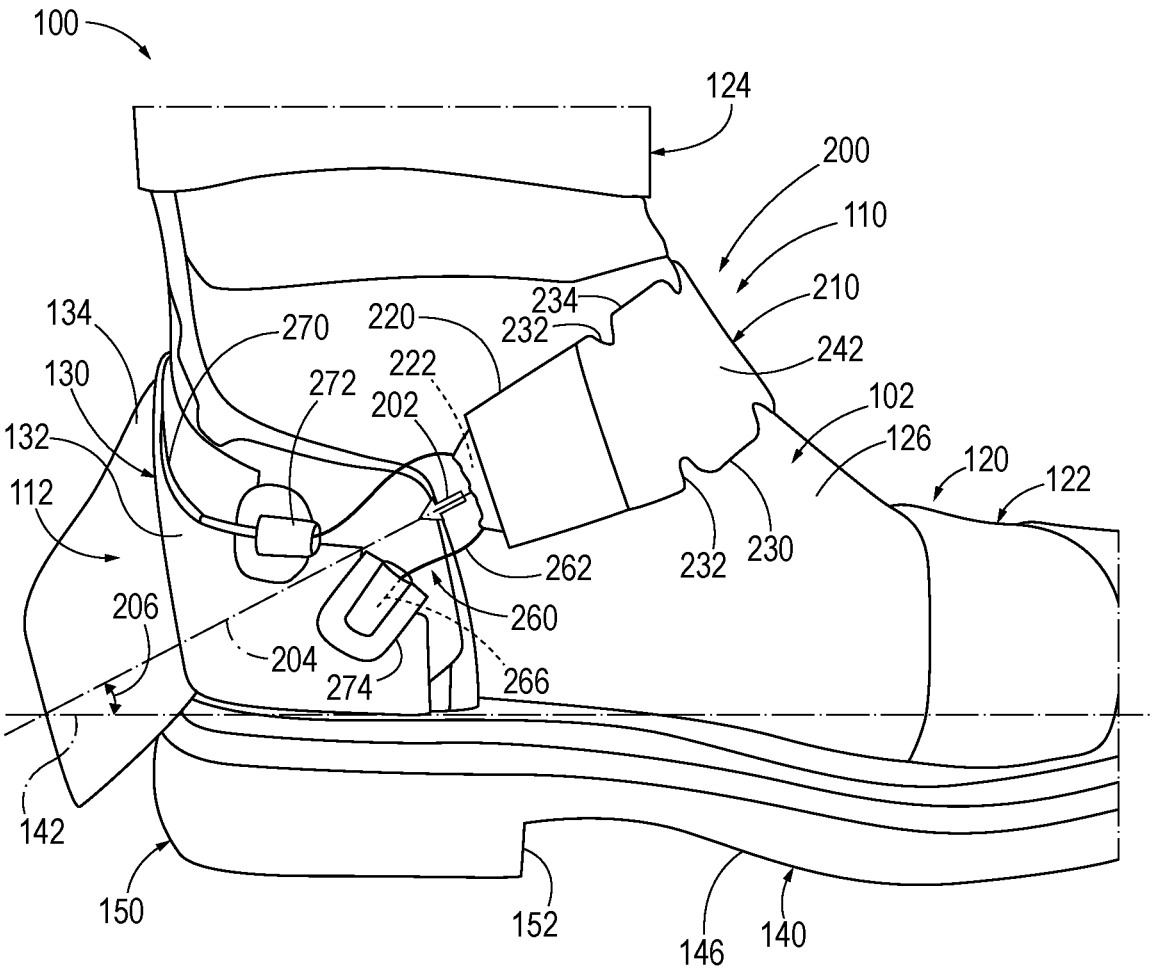
FIG. 6 is a fragmentary partially cutaway medial side view of a portion of a boot according to the present disclosure.
Figure 7:
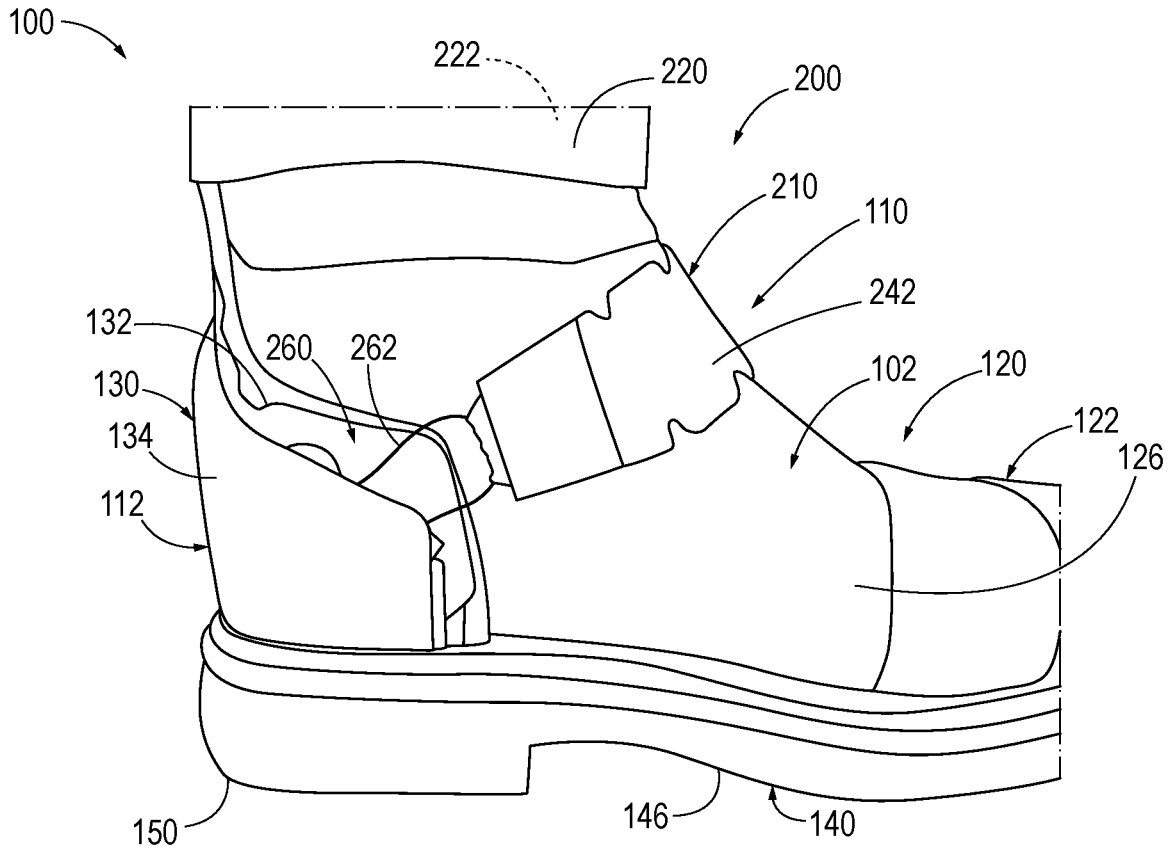
FIG. 7 is a fragmentary partially cutaway medial side view of a portion of a boot according to the present disclosure.

In some examples, and as schematically illustrated in the cutaway views of FIGS. 1-2, heel counter 130 is an internal heel counter that is positioned interior of external surface 114. In some examples, and as described in more detail below, at least a portion of fit adjustment system 200 is enclosed and/or concealed by at least a portion of heel counter 130. As a more specific example, and as schematically illustrated in FIGS. 1-2 and less schematically illustrated in FIGS. 6-12, heel counter 130 optionally may include an inner heel counter layer 132 and an outer heel counter layer 134, and one or more components of fit adjustment system 200 may be at least partially positioned between the inner heel counter layer and the outer heel counter layer. In FIG. 6, outer heel counter layer 134 is schematically illustrated as partially detached, or peeled away, from inner heel counter layer 132 to better illustrate components of fit adjustment system 200 that are positioned between the layers.

Figure 4:
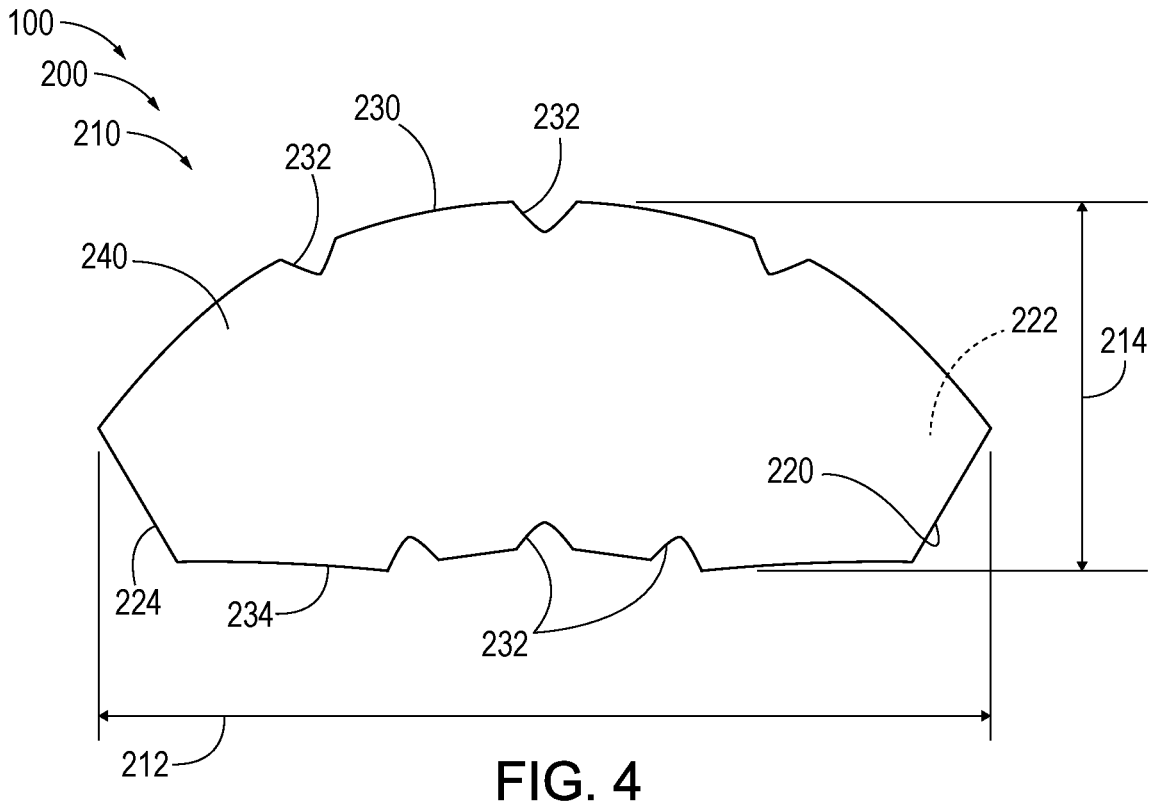
FIG. 4 is a bottom plan view illustrating an example of an instep pad according to the present disclosure.
Figure 5:
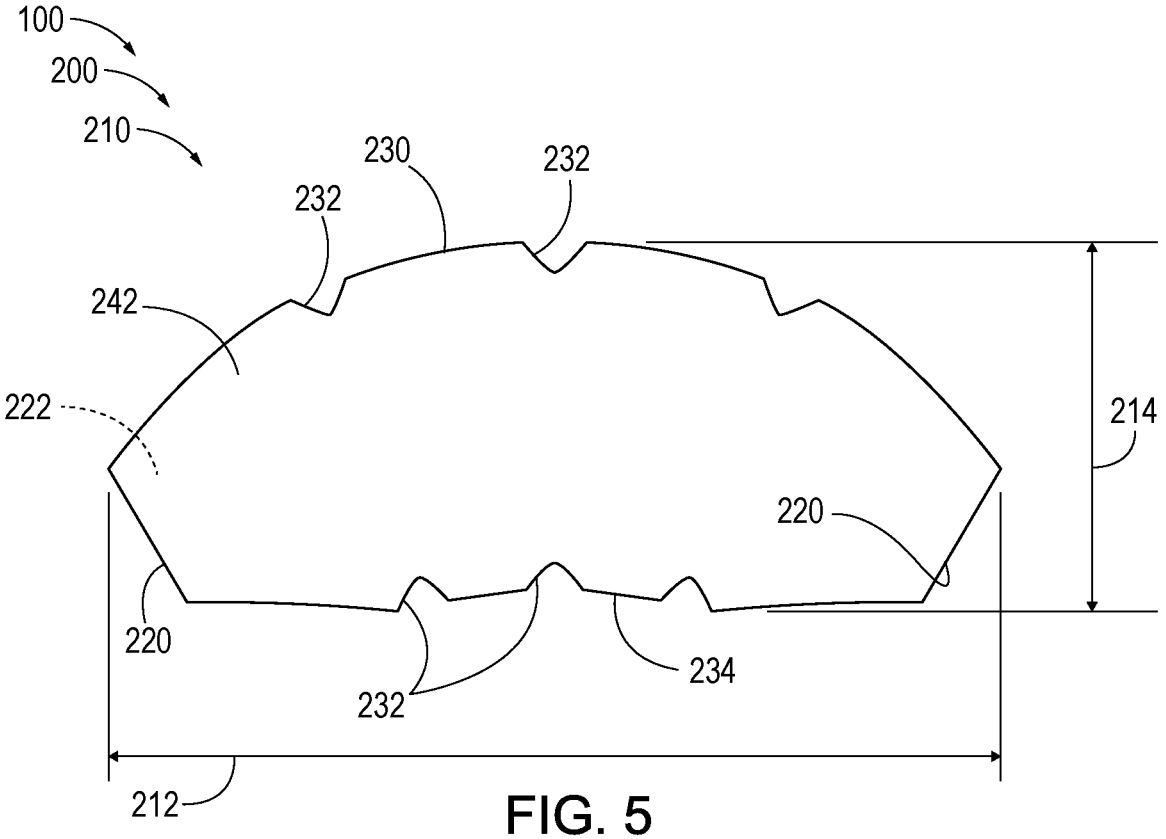
FIG. 5 is a top plan view illustrating an example of an instep pad according to the present disclosure.

In some examples, fit adjustment system 200 is at least substantially contained within boot 100. For example, fit adjustment system 200 may be configured such that various components of the fit adjustment system are concealed from view and/or restricted from direct contact or access by the wearer, such as due to concealment by external surface 114 of upper 120 and/or by outer heel counter layer 134 of heel counter 130. However, and as discussed herein, at least a portion of fit adjustment system 200, such as at least a portion of a lace adjustment mechanism 280 thereof, may be or extend external the external surface 114 of upper 120 to enable the wearer to selectively adjust the fit of the boot on the wearer's foot. FIGS. 3 and 6-12 illustrate examples of boot 100 with external surface 114 removed such that components of fit adjustment system 200 are visible, while FIGS. 4-5 illustrate an example of a component of fit adjustment system 200 in isolation, as discussed in more detail below.

In some examples, and as schematically illustrated in FIGS. 1-2 and less schematically illustrated in FIGS. 3 and 6-12, upper 120 may include a liner 126 positioned interior of external surface 114 (shown in FIGS. 1-2) such that the liner is configured to contact the wearer's foot when the boot is worn by the wearer. In some such examples, shell 122 may be described as including liner 126. When present, liner 126 may be formed of any of a variety of materials, examples of which include a fabric and/or a waterproof fabric. Liner 126 optionally may include a cushioning or padding layer, and as described in more detail herein, may prevent the wearer's foot from directly contacting fit adjustment system 200 when the boot is donned on the wearer's foot. In other words, liner 126, when present, may extend between the wearer's foot and components of fit adjustment system 200 to provide a physical barrier therebetween.

As used herein, descriptions of one or more components of boot 100 as engaging and/or contacting a body part of the wearer (e.g., a foot, a leg, etc.) also may be understood as referring to a configuration and/or circumstance when the component engages and/or contacts an article of clothing or other covering associated with the body part, such as a sock, a leg of a pair of breeches, a leg of a pair of pants, etc.

As schematically illustrated in FIGS. 1-2, fit adjustment system 200 includes an instep pad 210, a lace 260, and a lace adjustment mechanism 280. Instep pad 210 is positioned interior of the external surface of the upper within an instep region of the boot, and lace 260 is operatively coupled to the instep pad and configured to selectively exert a tightening force on the instep pad. For example, the tightening force may cause the instep pad to move toward the instep of the wearer's foot when the boot is worn and/or toward a heel region of the boot. Lace adjustment mechanism 280 is configured to be selectively actuated to adjust an adjustment length of the lace.

Fit adjustment system 200 is configured such that when lace adjustment mechanism 280 is selectively actuated to reduce the adjustment length of lace 260 while the boot is worn by the wearer, the tightening force is exerted by the lace on the instep pad along a lace tightening direction, which as discussed herein, may be directed toward heel region 112 of boot 100 and/or may direct instep pad 210 to engage the wearer's foot in such a manner that the instep pad draws the heel of the wearer's foot into secure engagement with heel region 112 of the boot. Additionally or alternatively, when lace adjustment mechanism 280 is selectively actuated to reduce the adjustment length of lace 260 when boot 100 is worn by the wearer, lace 260 is configured to urge the instep pad toward the instep of the wearer's foot via the tightening force to selectively tighten the boot upon the wearer's foot.

Expressed in slightly different terms, when lace adjustment mechanism 280 is selectively actuated to selectively reduce the adjustment length of lace 260, the lace draws instep pad 210 toward heel region 112 to secure the heel of the wearer's foot within and/or against the heel region. In this manner, actuating lace adjustment mechanism 280 to tighten a fit of boot 100 while the boot is worn by the wearer may operate to enhance engagement of the foot against instep region 110 of the boot, heel region 112 of upper 120, and the heel region of sole assembly 140, thereby stably securing the foot within the boot with at least three points of contact. As used herein, the term "tighten," as used to describe an action of fit adjustment system 200 and/or lace adjustment mechanism 280 upon boot 100 relative to the wearer's foot, is intended to refer to an action that results in a greater degree of engagement between the boot and the wearer's foot, such as by increasing a magnitude of a force exerted upon the foot by the boot and/or a surface area across which the force is applied.

By contrast, some conventional and prior pull-on boot designs may utilize a fit adjustment system that applies a force to the wearer's foot that is directed primarily downward and/or toward the sole assembly, such as proximate and/or even forward of heel breast 152, but that fails to fully secure the heel of the wearer's foot within a heel region of the boot. As described in more detail herein, fit adjustment systems 200 according to the present disclosure alleviate such shortcomings at least by directing tightening force 202 along a direction that urges the heel of the wearer's foot against heel region 112 of boot 100. More specifically, and as schematically illustrated in FIG. 1 and less schematically illustrated in FIG. 6, fit adjustment system 200 is configured such that, when lace adjustment mechanism 280 (shown in FIG. 1) is selectively actuated to selectively reduce the adjustment length 262 of lace 260, the lace exerts tightening force 202 on instep pad 210 along a lace tightening direction 204 that may be directed toward heel region 112 of boot 100. In some examples, and as discussed in more detail herein, lace tightening direction 204 may be directed toward heel counter 130, toward an intersection of the sole assembly and the shell at the rear of the boot, and/or above such an intersection.

Instep pad 210 is schematically illustrated in FIGS. 1-2 and less schematically illustrated in FIGS. 3-12. Instep pad 210 is positioned interior of external surface 114 of upper 120 (such as shown in FIGS. 1-2) within an instep region 110 of boot 100 (such as shown in FIGS. 1-3, 6-7, and 9-12). Specifically, instep region 110 refers to a region of boot 100 that extends, is positioned to extend, and/or is configured to extend adjacent to an instep of the wearer's foot when the boot is worn by the wearer. The instep of the wearer's foot additionally or alternatively may be referred to as the bridge of the wearer's foot, the transverse arch of the wearer's foot, and/or the upper surface of the wearer's foot above the arch of the wearer's foot. As used herein, an element that is described as being adjacent to another element additionally or alternatively may be described as being proximal and/or near, but it is not required to be in direct contact with or contiguous with unless expressly described as such.

In some examples, and as schematically illustrated in FIGS. 1-2, instep pad 210 is positioned between external surface 114 and liner 126. In such a configuration, liner 126 may be described as preventing contact between the wearer's foot and one or more of, the lace, the instep pad, the lace adjustment mechanism, and/or the entire fit adjustment system when the boot is worn by the wearer.

Lace 260 is operatively coupled to instep pad 210 and is configured to selectively exert a tightening force 202 (shown schematically in FIGS. 1 and 6) on the instep pad. Lace 260 may include and/or be any of a variety of flexible components for exerting tightening force 202 upon instep pad 210 as described herein, examples of which include a natural fiber lace, a synthetic lace, a string, a cord, a line, etc. Accordingly, lace 260 additionally or alternatively may be referred to herein as a string 260, a cord 260, a wire 260, and/or a line 260. Examples of suitable materials from which lace 260 may be formed include one or more of metal, nylon, fabric, and plastic. Lace 260 additionally or alternatively may be described as being non-elastic and/or formed from a non-elastic material or a material that does not elastically deform.

As implemented in fit adjustment system 200, lace 260 may be described as including an adjustment length 262 and a free length 264, with total length of the lace being the sum of the adjustment length and the free length. Adjustment length 262 is the portion of the length of lace 260 that couples instep pad 210 to a portion of the boot's sole assembly 140 of upper 120 and which is operatively coupled to lace adjustment mechanism 280 such that the length of the adjustment length is changed responsive to actuation of the lace adjustment mechanism. In some examples, the adjustment length 262 extends between and/or interconnects instep pad 210 with lace adjustment mechanism 280 and sole assembly 140 or upper 120. Free length 264 is the portion of the length of lace 260 that is not the adjustment length. In some examples, free length 264 may be described as extending from adjustment length 262, as extending from lace adjustment mechanism 280, as extending external the external surface of upper 120, as being distal lace adjustment mechanism 280 relative to adjustment length 262, and/or as being coiled, housed, or retained in the lace adjustment mechanism, as schematically illustrated in FIG. 1.

In some examples, lace 260 may be a discontinuous length (i.e., not form a continuous loop or band), with the total length of the lace being the sum of the adjustment length and the free length. In such examples, lace 260 may be described as including a pair of opposed ends, namely, an adjustment length end 266 and a free length end 268, as illustrated in at least FIG. 1. Thus, as lace adjustment mechanism 280 is actuated to adjust the adjustment length of lace 260, the total length of the lace does not change even though the adjustment length and the free length will reduce and increase, respectively.

As discussed, lace adjustment mechanism 280 (shown schematically in FIGS. 1-2) is configured to be selectively actuated to selectively permit and/or cause adjustment of an adjustment length 262 of lace 260. This adjustment of the adjustment length 262 may include increasing or reducing the adjustment length, and thus correspondingly reducing or increasing free length 264 of lace 260. Lace adjustment mechanism 280 thus may be described as having or being selectively configured between, an adjustment configuration and a locked configuration. In the adjustment configuration, the lace adjustment mechanism permits and/or causes adjustment of the adjustment length 262 of lace 260. In the locked configuration, the lace adjustment mechanism restricts, or prevents, adjustment of the adjustment length, thereby retaining fit adjustment system 200 and/or boot 100 in a selected relative orientation, or fit. The adjustment configuration additionally or alternatively may be referred to as an actuated configuration, and the locked configuration additionally or alternatively may be referred to as an unactuated configuration.

As schematically illustrated in FIG. 1, lace adjustment mechanism 280 includes a lace lock 282 that is configured to selectively engage lace 260 to define the adjustment length of the lace. When the lace adjustment mechanism is in the adjustment configuration, lace lock 282 permits adjustment of the adjustment length of the lace, and when the lace adjustment mechanism is in the locked configuration, lace lock 282 restricts or prevents adjustment of the adjustment length of the lace. Lace lock 282 may take any suitable form and/or may utilize any suitable structure to selectively engage and disengage lace 260 to thereby configure the lace adjustment mechanism between its adjustment configuration and its locked configuration. As examples, lace lock 282 may be or include a clamp 290 that is configured to restrict adjustment of the adjustment length when the lace adjustment mechanism is in the locked configuration.

Lace adjustment mechanism 280 further includes an actuator 292 that is configured to be manipulated by the wearer (or other individual proximate boot 100) to selectively configure the lace adjustment mechanism from the locked configuration to the adjustment configuration, or optionally between the adjustment configuration and the locked configuration. Actuator 292 additionally or alternatively may be referred to as, may include, and/or may be a button, level, dial, and/or plunger.

In some examples, lace adjustment mechanism 280, lace lock 282, and/or clamp 290 may be biased to the locked configuration, such as by a spring or resilient element, thereby requiring a wearer to exert sufficient forces on the lace adjustment mechanism to overcome this bias to selectively configure the lace adjustment mechanism to the adjustment configuration. At least a portion of actuator 292 extends external the external surface of upper 120 to facilitate its manipulation by the wearer or other individual while the boot is worn by the wearer. In some examples, some or all of the actuator, and/or some or all of the lace adjustment mechanism extends external the external surface of the upper of the boot. In some such examples, and as schematically illustrated in FIG. 1, external surface 114 may include an aperture 276 through which lace 260 extends to interconnect at least a portion, and optionally all, of the lace adjustment mechanism with the instep pad and a portion of the interior of the boot to which the adjustment length is secured.

In some examples, instep pad 210 may be described as extending across opposite sides of boot 100. More specifically, and as schematically illustrated in FIGS. 1-2 and less schematically (and perhaps best) illustrated in FIG. 3, boot 100 may be described as including a medial boot side 102 and a lateral boot side 104 that are separated by midline plane 106. In particular, when boot 100 is worn by the wearer, medial boot side 102 extends proximate to a medial side of the wearer's foot, lateral boot side 104 extends proximate to a lateral side of the wearer's foot, and/or midline plane 106 is coplanar with a sagittal plane of the wearer's foot.

Figure 3:
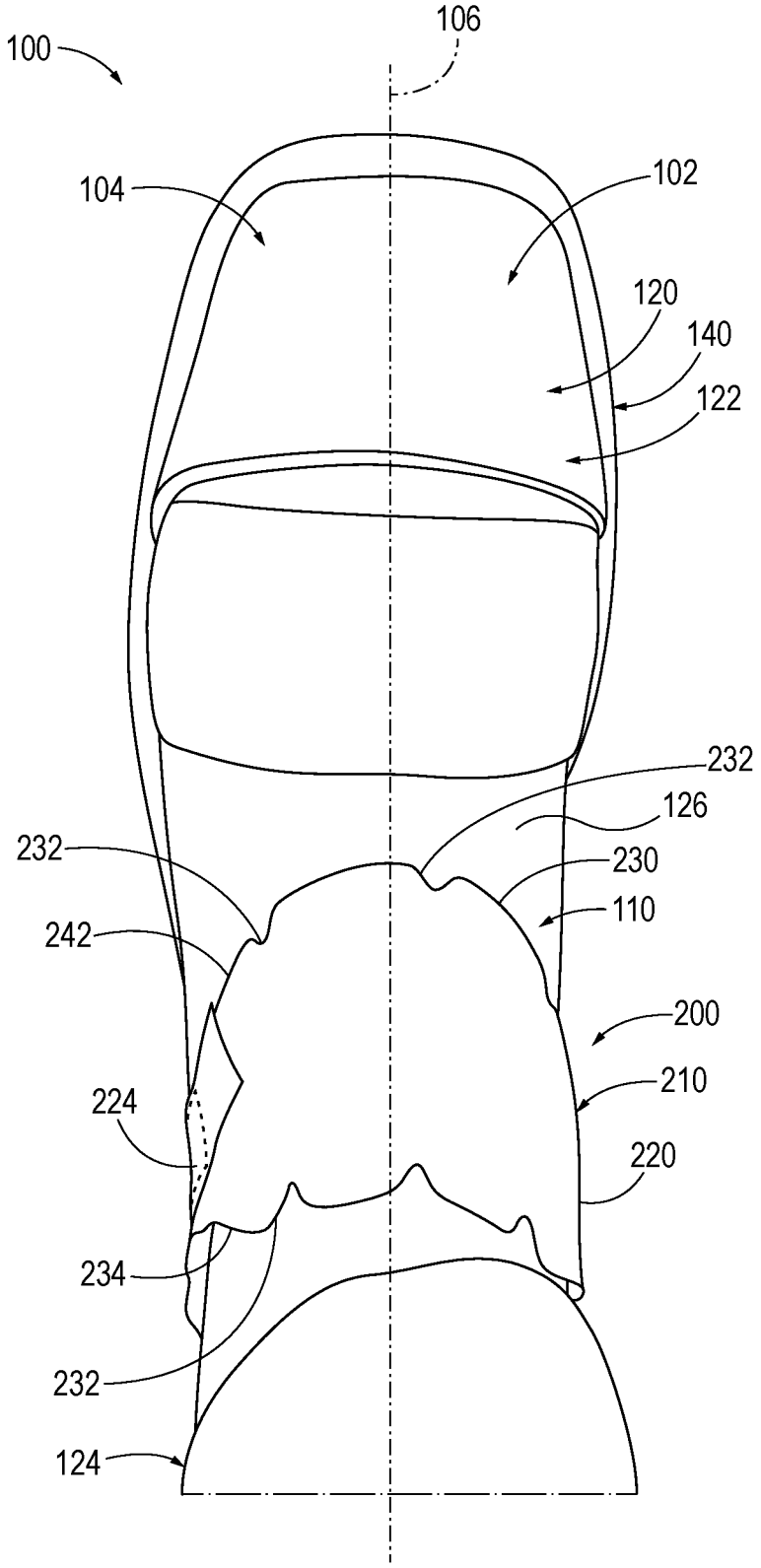
FIG. 3 is a partially cutaway top plan view illustrating an example of a boot according to the present disclosure.

In some examples, and as best illustrated in FIG. 3, instep pad 210 is configured to be at least substantially centered about (e.g., symmetrically positioned relative to) midline plane 106 when boot 100 is worn by the wearer, at least when the instep pad is drawn toward the instep of the wearer's foot to selectively tighten the boot upon the wearer's foot. That is, in some examples, instep pad 210 may be fixedly coupled to lateral boot side 104 and adjustably coupled to medial boot side 102 such that exerting tightening force 202 on instep pad 210 operates to draw a greater proportion of the instep pad toward and/or into the medial boot side. Accordingly, in such examples, it may be desirable to configure fit adjustment system 200 such that instep pad 210 is at least substantially symmetric about the sagittal plane of the wearer's foot when the boot is fully secured to the wearer's foot, such as to facilitate an even distribution of pressure upon the wearer's foot by the instep pad. While the present disclosure generally relates to examples in which instep pad 210 may be fixedly coupled to lateral boot side 104 and adjustably coupled to medial boot side 102, this is not required of all examples of boot 100, and it additionally is within the scope of the present disclosure that instep pad 210 may be fixedly coupled to medial boot side 102 and adjustably coupled to lateral boot side 104. This is illustrated schematically in FIGS. 1 and 2 by also indicating the medial and lateral boot sides 102 and 104 in dashed lines.

Fit adjustment system 200 may be configured such that lace tightening direction 204 has any suitable direction and/or orientation for securing the heel of the wearer's foot within heel region 112. For example, and as schematically illustrated in FIG. 1 and less schematically illustrated in FIG. 6, lace tightening direction 204 may be characterized by an orientation of lace tightening direction 204 relative to a sole assembly plane 142 of boot 100. In particular, as used herein, sole assembly plane 142 refers to a plane that extends perpendicular to midline plane 106 such that at least a portion of sole assembly 140 extends within the sole assembly plane. As a more specific example, sole assembly plane 142 may be oriented such that at least a portion of the wearer's foot contacts sole assembly 140 at the sole assembly plane when the boot is worn by the wearer. In this manner, sole assembly plane 142 may be described as generally representing an orientation of a bottom of the wearer's foot when the boot is worn by the wearer. However, it is to be understood that boot 100 and/or sole assembly 140 still may define and/or be characterized by sole assembly plane 142 even when the boot is not worn by the wearer. While FIGS. 1-2 schematically illustrate sole assembly plane 142 as being horizontal (e.g., parallel to a ground surface upon which the boot rests), this is not required of all examples of boot 100, and it additionally is within the scope of the present disclosure that the sole assembly plane may be sloped relative to a ground surface.

As schematically illustrated in FIG. 1 and less schematically illustrated in FIG. 6, lace tightening direction 204 may be characterized by a tightening angle 206 measured relative to sole assembly plane 142. More specifically, tightening angle 206 represents an angle as measured between sole assembly plane 142 and a projection of lace tightening direction 204 onto midline plane 106 (i.e., an orientation of the lace tightening direction as viewed along a direction perpendicular to the midline plane). As more specific examples, tightening angle 206 may be at least 30 degrees, at least 35 degrees, at least 40 degrees, at least 45 degrees, at least 50 degrees, at least 55 degrees, at most 60 degrees, at most 52 degrees, at most 47 degrees, at most 42 degrees, at most 37 degrees, and/or at most 32 degrees. In some examples, fit adjustment system 200 may be configured such that tightening angle 206 is about 45 degrees, such as at least 40 degrees and at most 50 degrees. Specifically, configuring fit adjustment system 200 such that tightening angle 206 is close to 45 degrees may provide a balance between instep pad 210 drawing the wearer's foot toward sole assembly 140 and the instep pad drawing the wearer's foot toward heel region 112 of upper 120.

In some examples, lace tightening direction 204 additionally or alternatively may be characterized in terms of an intersection point of the lace tightening direction (or a projection thereof onto midline plane 106) with sole assembly plane 142 and/or with another component of boot 100. As an example, and as schematically illustrated in FIG. 1 and less schematically illustrated in FIG. 6, fit adjustment system 200 may be configured such that the projection of lace tightening direction 204 onto midline plane 106 intersects heel counter 130. Additionally or alternatively, fit adjustment system 200 may be configured such that the projection of lace tightening direction 204 onto midline plane 106 intersects sole assembly plane 142 at a location that is within heel region 112, that is within heel counter 130, that is exterior (external) of sole assembly 140, and/or that is exterior of boot 100. In particular, FIGS. 1 and 6 illustrate examples in which the projection of lace tightening direction 204 onto midline plane 106 (shown in FIG. 1) intersects sole assembly plane 142 at a location that is behind heel counter 130, and thus that is exterior of boot 100. Configuring fit adjustment system 200 in this manner may help ensure that tightening force 202 is directed sufficiently rearward that the tightening force operates to secure the heel of the wearer's heel region 112 of boot 100.

Figure 11:
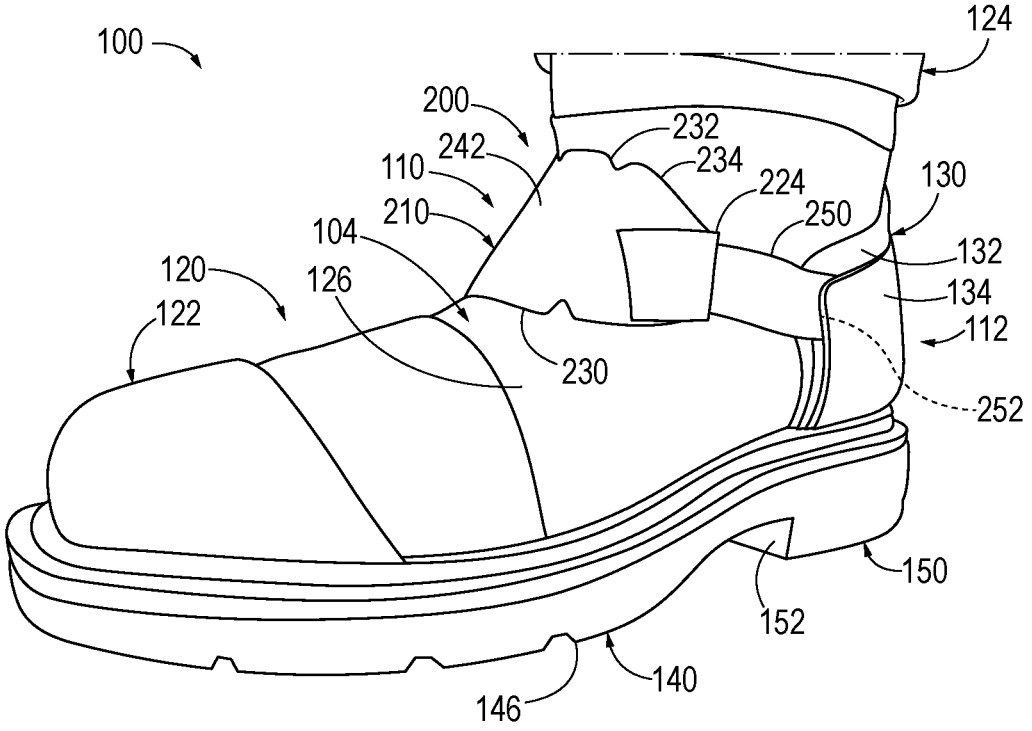
FIG. 11 is a fragmentary partially cutaway front lateral side view of a portion of a boot according to the present disclosure.
Figure 12:
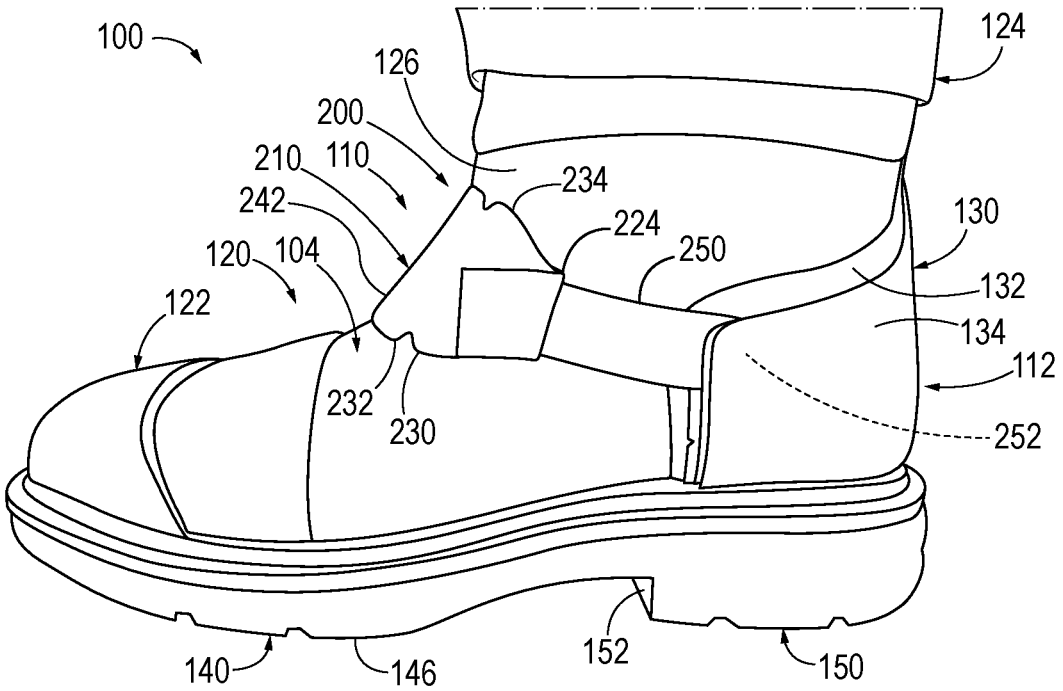
FIG. 12 is a fragmentary partially cutaway lateral side view of a portion of a boot according to the present disclosure.

Various features and dimensions of an example of instep pad 210 are perhaps best illustrated in FIGS. 4-5, which respectively represent bottom and top plan views of the example of the instep pad that is illustrated in FIG. 3. With reference to FIGS. 1-2 and 4-5, instep pad 210 may be described as including an adjustment end 220 (shown in FIGS. 1 and 4-5) and an anchor end 224 (shown in FIGS. 2 and 4-5). In some examples, such as in the examples of FIGS. 3 and 6-12, adjustment end 220 is positioned within medial boot side 102 (as shown in FIGS. 3 and 6-10) and anchor end 224 is positioned within lateral boot side 104 (as shown in FIGS. 3 and 11-12). However, this is not required of all examples of boot 100, and it additionally is within the scope of the present disclosure that adjustment end 220 may be positioned in lateral boot side 104 and anchor end 224 may be positioned in medial boot side 102.

With continued reference to FIGS. 1-2 and 4-5, instep pad 210 also may be described as including an anterior edge 230 and a posterior edge 234 such that the anterior edge is positioned forward of the posterior edge and such that each of the anterior edge and the posterior edge extends between adjustment end 220 and anchor end 224. In some examples, and as schematically illustrated in FIGS. 1-2 and less schematically illustrated at least in FIGS. 4-5, anterior edge 230 and/or posterior edge 234 optionally include, or define, one or more compliance notches 232 that are configured to facilitate conforming of instep pad 210 to the wearer's foot without introducing wrinkles or folds in the instep pad. That is, in such examples, compliance notches 232 may enable the instep pad to bend and/or flex through sufficient degrees of freedom to ensure that instep pad 210 is capable of conforming to the three-dimensional contours of the wearer's foot (and/or of a portion of upper 120 extending between the instep pad and the wearer's foot).

In some examples, and as illustrated in the example of FIGS. 4-5, instep pad 210 may be characterized in terms of an instep pad width 212 and/or an instep pad length 214 thereof. In particular, and as illustrated in FIGS. 4-5, instep pad width 212 is measured between adjustment end 220 and anchor end 224, while instep pad length 214 is measured between anterior edge 230 and posterior edge 234. As illustrated in FIGS. 4-5, instep pad width 212 and instep pad length 214 may be described as referring to dimensions of instep pad 210 when the instep pad is laid flat such that the instep pad extends in a single plane. However, it is to be understood that instep pad 210 may be coupled to and/or contained within upper 120 in such a manner that the instep pad does not assume such a flat configuration when the instep pad is operatively installed and/or assembled within boot 100. Accordingly, instep pad width 212 and instep pad length 214 may be described as representing dimensions of the instep pad as measured prior to assembling the instep pad within the boot.

In some examples, one or both of instep pad width 212 and/or instep pad length 214 is selected to enhance an area over which instep pad 210 applies pressure to the wearer's foot while ensuring that the instep pad is suitably dimensioned to conform to the wearer's foot. In general, increasing a surface area of instep pad 210, such as by increasing instep pad width 212 and/or instep pad length 214, may result in a given total force exerted by the instep pad upon the wearer's foot being distributed across a greater surface area of the wearer's foot, thus reducing the localized pressure that is applied to the wearer's foot. However, expanding the dimensions of the instep pad in this manner also may result in the instep pad being less flexible and/or compliant through multiple degrees of freedom, thus detracting from an ability of the instep pad to conform to any of a variety of foot shapes. Accordingly, instep pad 210 may be designed or otherwise constructed such that instep pad width 212 is greater than instep pad length 214 to ensure that pressure is applied across a suitably wide area of the wearer's foot while ensuring that the instep pad remains sufficiently flexible to conform to the wearer's foot. More specifically, instep pad 210 may be characterized in terms of a ratio of instep pad width 212 to instep pad length 214, examples of which include ratios that are at least 1.5:1, at least 2:1, at least 2.5:1, at least 3:1, at least 3.5:1, at least 4:1, at most 4.5:1, at most 3.7:1, at most 3.2:1, at most 2.7:1, at most 2.2:1, and/or at most 1.7:1.

Instep pad 210 may feature any appropriate material construction for applying a force to the wearer's foot comfortably and effectively. In some examples, and as schematically illustrated in FIGS. 1-2 and less schematically illustrated in FIG. 4, instep pad 210 includes a cushioning layer 240 that is configured to resiliently compress to conform to the wearer's foot when the boot is worn by the wearer. In such examples, cushioning layer 240 may be formed of any of a variety of materials, examples of which include a foam, an open-cell foam, polyurethane (PU), and/or ethylene-vinyl acetate (EVA). In particular, constructing cushioning layer 240 of an open-cell foam may facilitate and/or enhance a breathability of instep pad 210.

Additionally or alternatively, in some examples, and as schematically illustrated in FIGS. 1-2 and less schematically illustrated in FIGS. 5-12, instep pad 210 includes a structural layer 242. In such examples, structural layer 242 may be formed of a material that is less compliant than cushioning layer 240, examples of which include a nylon, a leather, a plastic, a thermoplastic, and/or thermoplastic polyurethane (TPU). Accordingly, in such examples, structural layer 242 may operate to resist stretching of instep pad 210, such as along a direction corresponding to instep pad width 212 and/or instep pad length 214. In examples of instep pad 210 that include both a cushioning layer 240 and a structural layer 242, structural layer 242 may be operatively coupled to cushioning layer 240 (labelled in FIGS. 1-2) such that the cushioning layer is positioned proximate to the wearer's foot relative to the structural layer when the boot is worn by the wearer. Stated differently, in such examples, cushioning layer 240 may be described as extending below structural layer 242, while cushioning layer 240 may ensure that engagement between instep pad 210 and the wearer's foot remains compliant and comfortable to the wearer.

In some examples, such as in the example of FIGS. 4-5, structural layer 242 and cushioning layer 240 are at least substantially coextensive with one another. Stated differently, structural layer 242 and cushioning layer 240 may have respective dimensions that are at least substantially identical to one another, such as along directions corresponding to instep pad width 212 and/or instep pad length 214. In some examples, structural layer 242 and cushioning layer 240 are co-molded with one another. Additionally or alternatively, structural layer 242 and cushioning layer 240 may be operatively coupled to one another, such as via mechanical fastening, stitching, and/or an adhesive.

Lace 260 may assume any of a variety of forms and/or configurations for applying tightening force 202 to instep pad 210. As an example, and as schematically illustrated in FIG. 1 and less schematically illustrated at least in FIGS. 6 and 8, fit adjustment system 200 may include a lace terminator 274 such that at least a portion of lace 260 is fixedly coupled to the lace terminator and extends from the lace terminator to lace adjustment mechanism 280 (shown in FIG. 1) via instep pad 210. In some examples, adjustment length end 266 may be fixedly coupled to the lace terminator. In some examples, lace terminator 274 is configured and/or oriented to direct lace 260 at least partially toward adjustment end 220 of instep pad 210. For example, and as schematically illustrated in FIG. 1 and less schematically illustrated at least in FIG. 6, lace terminator 274 may be oriented such that lace 260 extends between the lace terminator and adjustment end 220 of instep pad 210 along a direction that is at least substantially parallel to tightening force 202 and/or to lace tightening direction 204.

Figure 8:
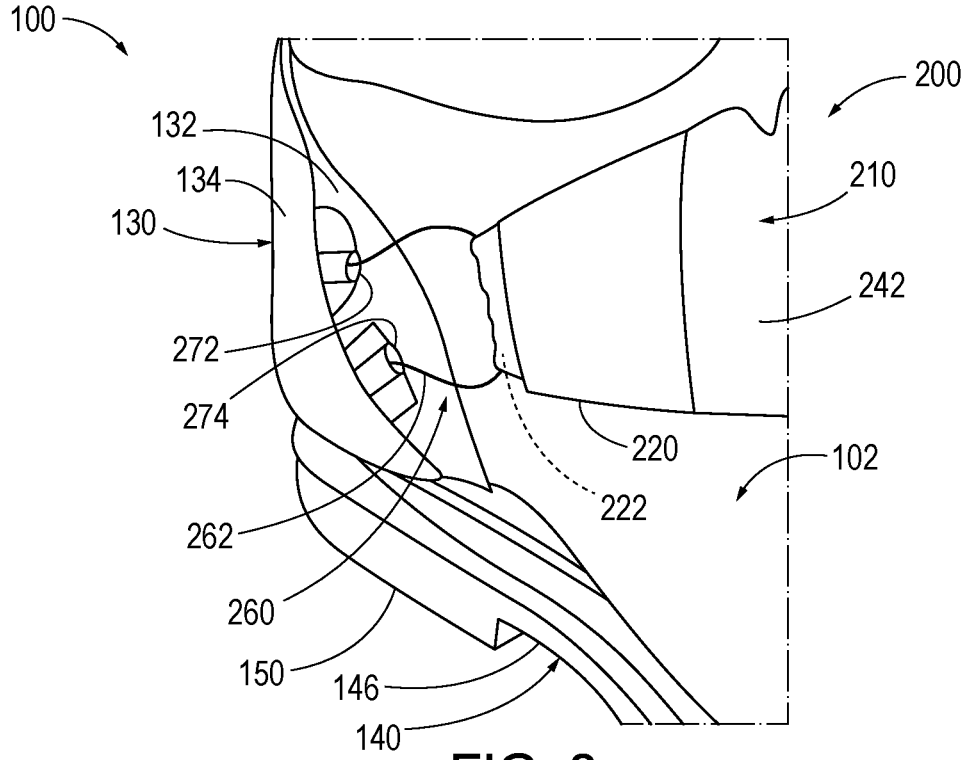
FIG. 8 is a fragmentary partially cutaway front medial side view of a portion of a boot according to the present disclosure.
Figure 9:
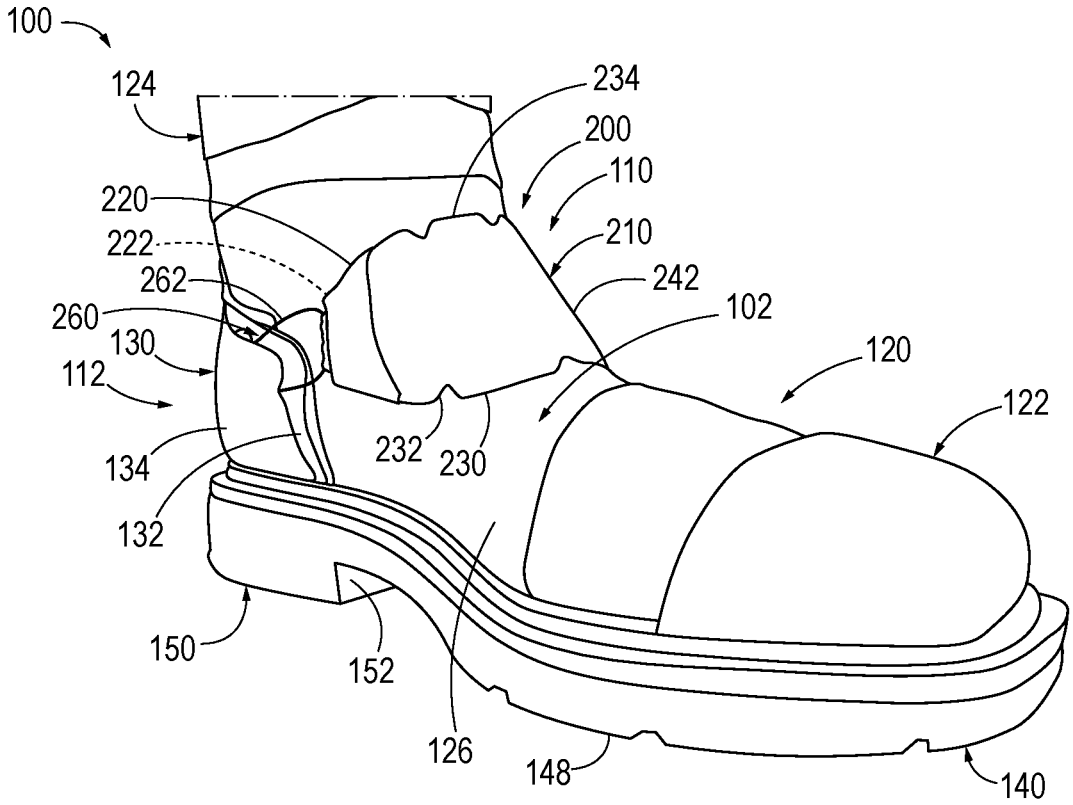
FIG. 9 is a fragmentary partially cutaway front medial side view of a portion of a boot according to the present disclosure.
Figure 10:
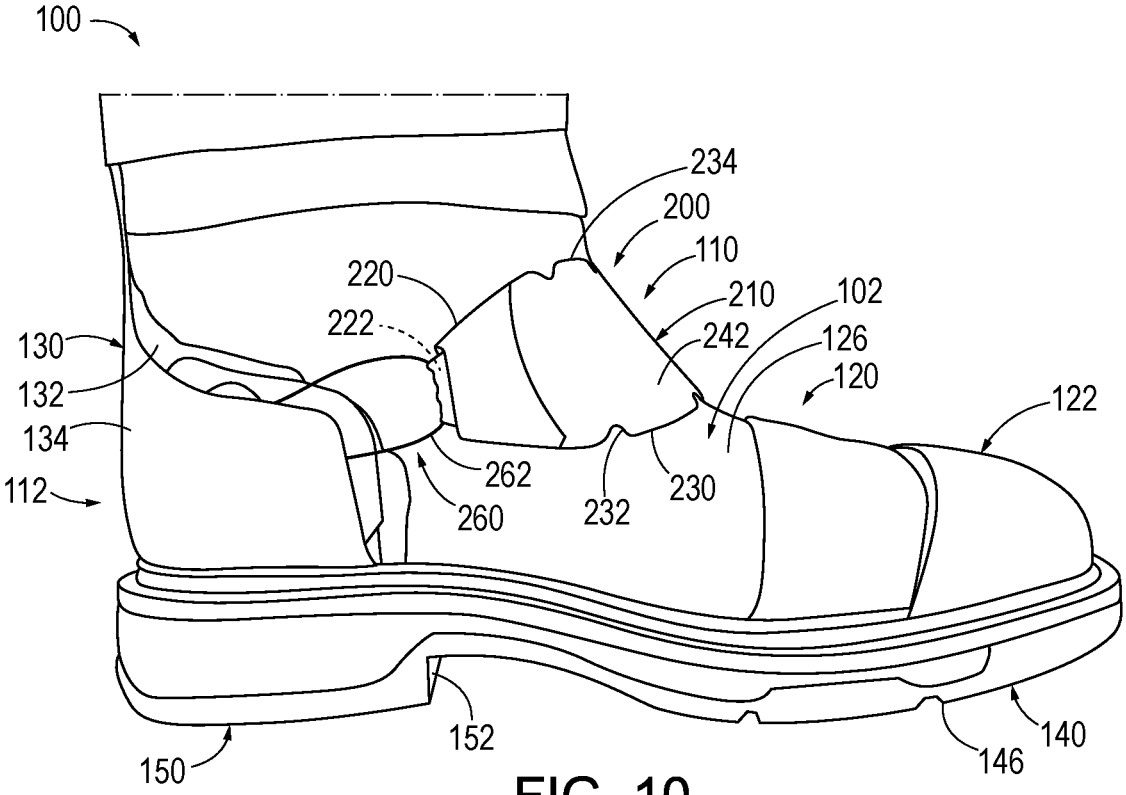
FIG. 10 is a fragmentary partially cutaway medial side view of a portion of a boot according to the present disclosure.

In some examples, and as schematically illustrated in FIG. 1 and less schematically illustrated at least in FIGS. 6 and 8, fit adjustment system 200 additionally includes at least one lace guide 272, such that lace 260 extends between lace terminator 274 and lace adjustment mechanism 280 (shown in FIG. 1) via the lace guide. More specifically, in some examples, lace 260 extends between lace guide 272 and lace terminator 274 via adjustment end 220 of instep pad 210, such as via instep pad lace channel 222. When present, lace guide 272 may be configured to support and/or guide lace 260 relative to upper 120, and/or to slidingly engage the lace as lace adjustment mechanism 280 is selectively actuated to selectively adjust the adjustment length of lace 260. In particular, lace guide 272 may be configured to direct lace 260 at least partially toward adjustment end 220 of instep pad 210. For example, lace guide 272 may be positioned and/or oriented so as to mitigate a force of friction between lace 260 and the lace guide while the lace slidingly engages the lace guide while also ensuring that a localized radius of curvature of the lace between lace terminator 274 and lace adjustment mechanism 280 is equal to or greater than a predetermined minimum radius of curvature. Accordingly, positioning and/or orienting lace guide 272 in this manner may ensure that a frictional wear of lace 260 is mitigated and/or minimized during operative use of fit adjustment system 200. Lace guide 272 may include and/or be any of a variety of structures for engaging, supporting, and/or directing lace 260, examples of which include a groove, a channel, a tunnel, and/or a hook.

In some examples, and as schematically illustrated in FIG. 1 and less schematically illustrated at least in FIGS. 6 and 8, lace guide 272 and/or lace terminator 274 is fixedly coupled to upper 120, to heel region 112, and/or to heel counter 130. However, this is not required of all examples of boot 100, and it additionally is within the scope of the present disclosure that lace guide 272 and/or lace terminator 274 may be fixedly coupled to upper 120 at a location that is adjacent to heel region 112 and/or to heel counter 130.

In some examples, and as schematically illustrated in FIG. 1 and less schematically illustrated in FIG. 6, fit adjustment system 200 additionally includes a lace conduit 270 that is configured to enclose at least a portion of lace 260 between lace adjustment mechanism 280 and lace guide 272. Specifically, in such examples, lace conduit 270 generally encloses lace 260 along a greater length of adjustment length 262 relative to lace guide 272, such as to further support and/or guide the lace relative to upper 120. Similar to lace guide 272, lace conduit 270 may be configured to slidingly engage lace 260 as lace adjustment mechanism 280 is selectively actuated to selectively adjust the adjustment length of lace 260, and/or may be fixedly coupled to upper 120 and/or to heel counter 130. In some examples, and as illustrated in FIG. 6, lace conduit 270 terminates at lace guide 272 such that lace 260 remains enclosed by the lace conduit and/or by the lace guide as the lace extends between the lace conduit and the lace guide.

Instep pad 210 may be operatively coupled to upper 120 and/or to sole assembly 140 in any of a variety of manners. For example, and as schematically illustrated in FIG. 1 and less schematically illustrated in FIGS. 6-10, lace 260 may be operatively and adjustably coupled to adjustment end 220 of instep pad 210. More specifically, in some examples, and as schematically illustrated in FIG. 1 and less schematically illustrated in FIGS. 6-10, adjustment end 220 includes an instep pad lace channel 222 such that lace 260 extends through the instep pad lace channel. In such examples, when lace adjustment mechanism 280 is selectively actuated to selectively adjust the adjustment length of lace 260, a portion of the lace extending through instep pad lace channel 222 exerts tightening force 202 on adjustment end 220 along lace tightening direction 204. More specifically, in such examples, selectively actuating lace adjustment mechanism 280 to shorten adjustment length 262 of lace 260 causes the lace to slide through instep pad lace channel 222 while applying tightening force 202 against a portion of the instep pad that defines the instep pad lace channel. As a result, the adjustment end is urged to move toward heel region 112 along lace tightening direction 204.

In some examples, anchor end 224 of instep pad 210 is non-adjustably coupled to another component of boot 100, such as upper 120 and/or heel assembly 150. For example, and as schematically illustrated in FIG. 2 and less schematically illustrated in FIGS. 11-12, fit adjustment system 200 may include an anchor strap 250 that is fixedly coupled to a strap anchor location 252 of boot 100. In some such examples, and as schematically illustrated in FIG. 2 and less schematically illustrated in FIGS. 11-12, anchor strap 250 is fixedly coupled to anchor end 224 of instep pad 210, such as via stitching, box stitching, and/or reinforced stitching. However, this is not required of all examples of fit adjustment system 200, and it additionally is within the scope of the present disclosure that instep pad 210 may include and/or define anchor strap 250. In such examples, anchor strap 250 may be described as including anchor end 224, and/or the anchor end may be described as being fixedly coupled to strap anchor location 252. In some examples, lace 260 may be described as not engaging anchor end 224 and/or only engaging a portion of the instep pad that is distal, or spaced away from, anchor end 224.

Strap anchor location 252 may be positioned at any suitable location within boot 100 such that applying tightening force 202 to adjustment end 220 operates to draw the heel of the wearer's foot toward heel region 112 of the boot. Accordingly, in some examples, and as schematically illustrated in FIG. 2 and less schematically illustrated in FIGS. 11-12, strap anchor location 252 is positioned within heel region 112. In other examples, strap anchor location 252 may be positioned suitably adjacent to heel region 112 to ensure that applying tightening force 202 to adjustment end 220 operates to draw the heel of the wearer's foot toward heel region 112 of the boot. In some examples, and as schematically illustrated in FIG. 2 and less schematically illustrated in FIGS. 11-12, upper 120 and/or heel counter 130 includes strap anchor location 252. However, this is not required of all examples of boot 100, and it additionally is within the scope of the present disclosure that sole assembly 140 includes strap anchor location 252.

As used herein, a first component may be described as being fixedly coupled to a second component when the first component and the second component are directly coupled to one another at a connection point such that the first component and the second component are not configured to move (e.g., translate) relative to one another at the connection point. In this manner, a description of a first component being fixedly coupled to a second component does not preclude a portion of either component that is spaced apart from the connection point from moving relative to the other component and/or relative to the connection point. Accordingly, as an example, two flexible components may be described as being fixedly coupled to one another when the two components are fixed relative to one another at the connection point (e.g., via stitching, adhesives, etc.) even when other portions of the components are free to flex and/or move relative to the connection point.

Anchor strap 250 may include and/or be any of a variety of structures for anchoring instep pad 210 to strap anchor location 252. As examples, anchor strap 250 may include and/or be a flexible structure, a strap, a webbing, a belt, a cord, a band, etc. In some examples, instep pad 210 and/or anchor strap 250 is not configured to stretch, such as along a longitudinal dimension thereof, during operative use of fit adjustment system 200. Stated differently, fit adjustment system 200 may be configured such that instep pad 210 and/or anchor strap 250 is at least substantially fixed in length during operative use of the fit adjustment system.

Figure 13:
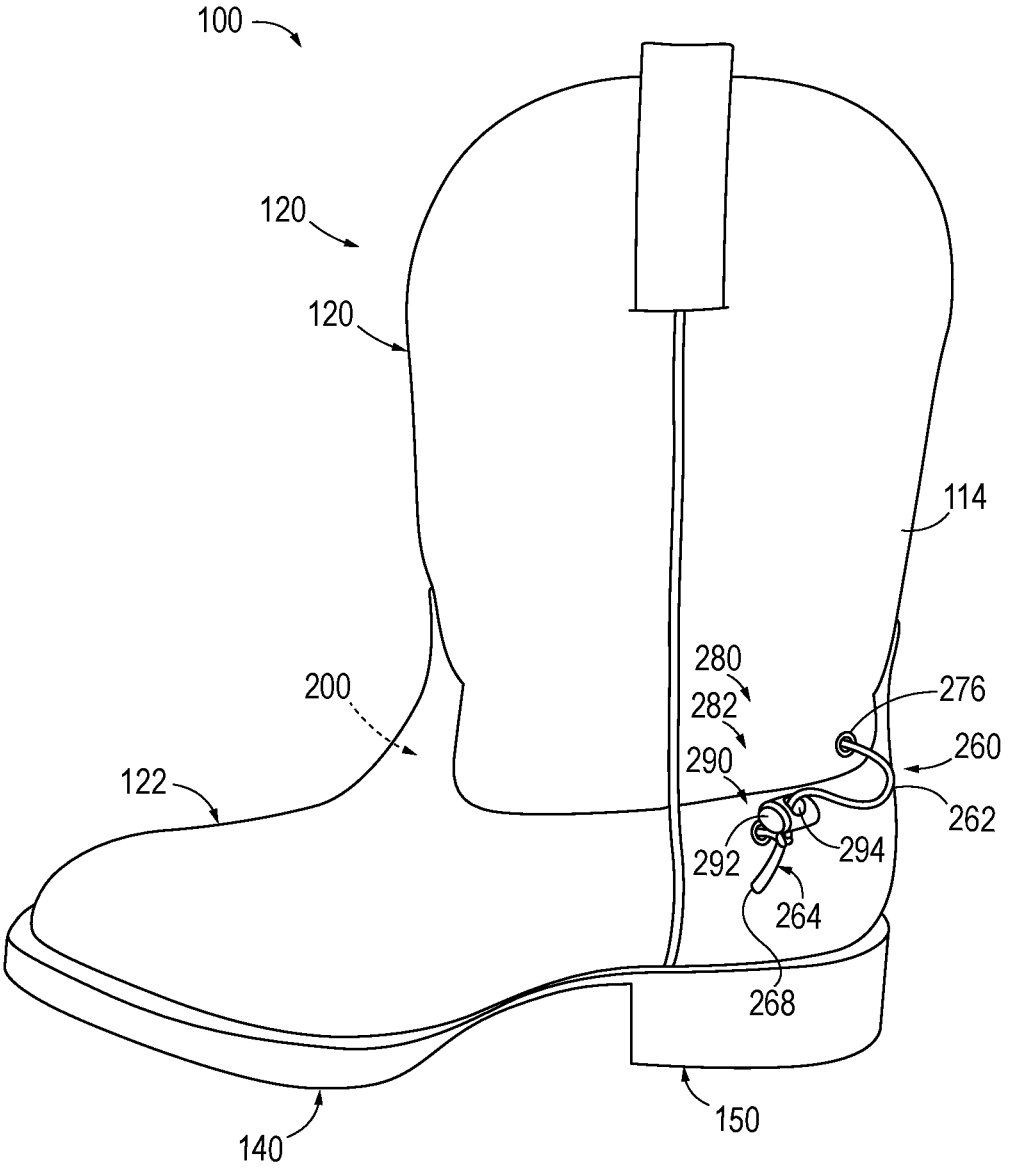
FIG. 13 is a side elevation view of a boot according to the present disclosure.
Figure 14:
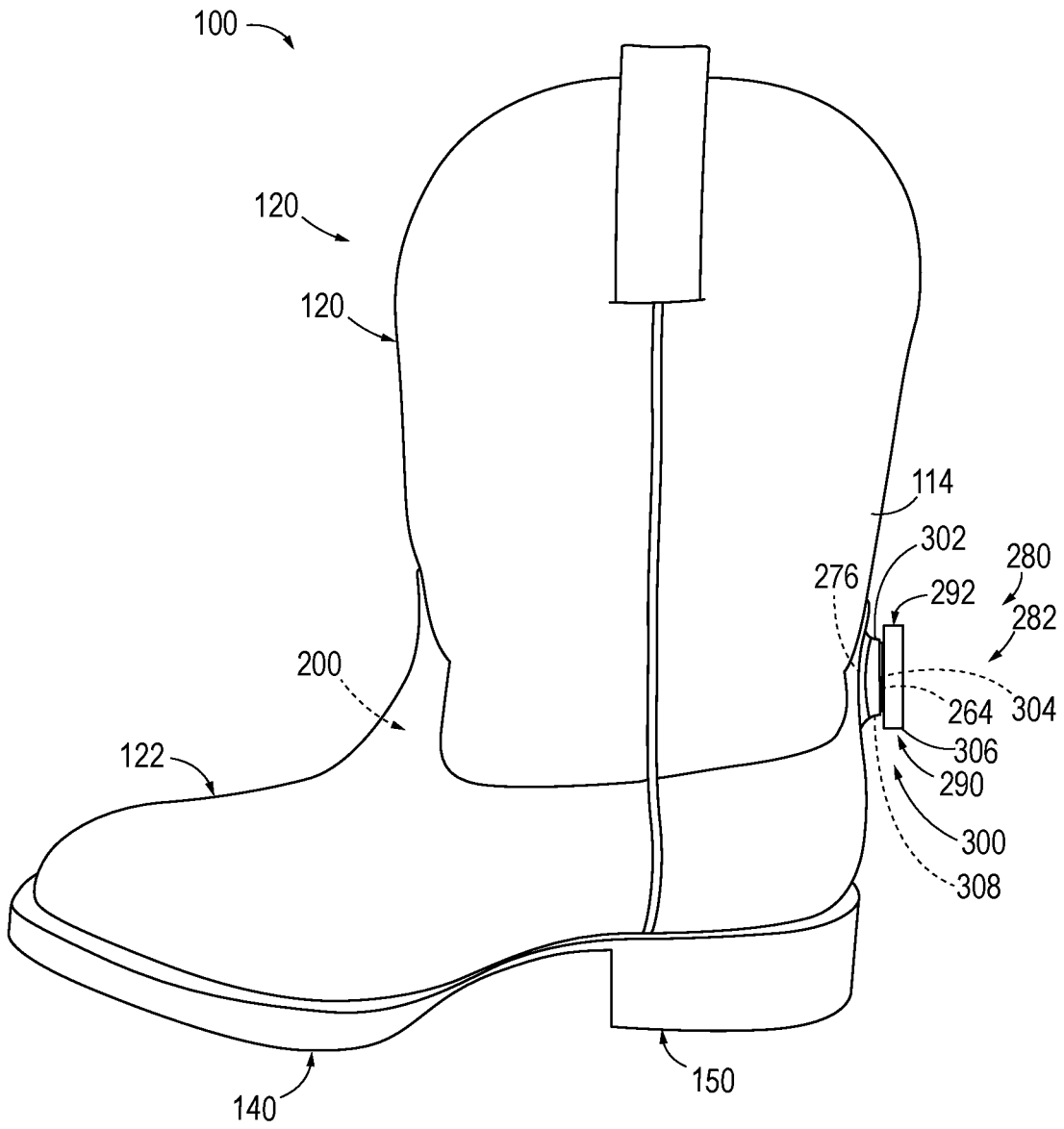
FIG. 14 is a side elevation view of another boot according to the present disclosure.
Figure 15:
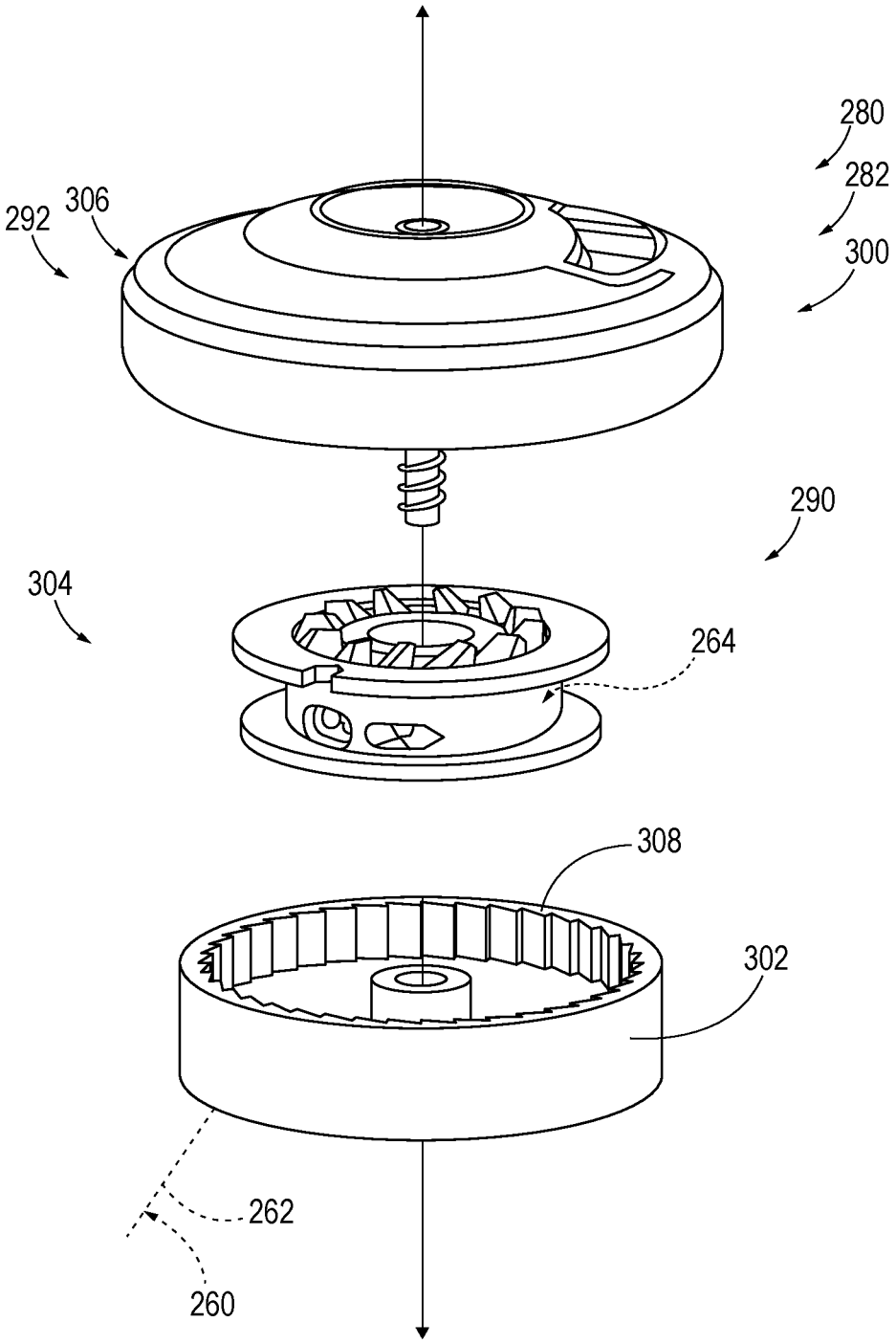
FIG. 15 is an exploded isometric view showing a portion of the lace adjustment mechanism of FIG. 14.

In FIGS. 13-15, additional examples of boots 100 with fit adjustment systems 200 according to the present disclosure are shown. Unless otherwise indicated, the examples of boots 100 shown and/or described in connection with FIGS. 13-15 may include the same components, features, and/or options as the examples of boots 100 that are shown and/or described in connection with FIGS. 1-12. Thus, each of the features of boot 100, fit adjustment system 200, and components thereof will not be described again in connection with respect to FIGS. 13-15, and each component and subcomponent similarly will not be indicated in FIGS. 13-15. Moreover, any additional components, features and/or options described and/or illustrated in connection with FIGS. 13-15 may be implemented with other boots 100 according to the present disclosure, including boots 100 described and/or illustrated in connection with FIGS. 1-12.

FIG. 13 provides a less schematic example of a boot 100 with a fit adjustment system 200. The internal components of fit adjustment system 200 and boot 100 are not illustrated in FIG. 13, but as discussed, may correspond to the components described and/or illustrated in FIGS. 1-12. In the example of FIG. 13, boot 100 is a pull-on boot that is free of mechanical and/or adjustable fasteners, such as tied laces, buckles, zippers, etc., for adjusting a fit of the boot upon the wearer's foot by constricting the external dimensions of the boot's upper and/or reducing the perimeter of the external surface of the boot's upper. FIG. 13 also provides an example of a boot 100 that includes a heel, or heel assembly, 150 that is an external heel assembly that projects from the boot's sole assembly 140.

In the example of fit adjustment system 200 shown in FIG. 13, a portion of lace 260 and all of lace adjustment mechanism 280 are positioned, or are located, external of external surface 114 of the boot's upper 120. In this example, upper 120 includes aperture 276 a lower region of shaft 124 on the medial side of the boot, but as discussed, aperture 276 optionally may extend through shell 122 or be otherwise positioned on the shaft or shell, such as in the positions schematically illustrated in FIGS. 1 and 2. In FIG. 13, adjustment length 262 of lace 260 extends through aperture 276, and lace lock 282 includes a clamp 290 in the form of a spring-biased plunger or "cord lock" that includes a locking aperture 294 through which the lace extends. The portion of lace 260 extending from locking aperture 294 to the adjustment length end (within the interior of boot 100) forms the adjustment length 262 of the lace. The portion of the lace extending from locking aperture 294 to free length end 268 forms free length 264 of lace 260. In FIG. 13, actuator 292 takes the form of the head, or button, of the spring-biased plunger.

In use, the wearer or another individual proximate boot 100 may depress the plunger to configure the lace adjustment mechanism to an adjustment configuration in which the lace may be slid through locking aperture 294 to adjust the relative portions of lace 260 that form adjustment length 262 and free length 264. By lengthening the adjustment length while the lace adjustment mechanism is in the adjustment configuration, the instep pad may be urged away from the heel assembly of the boot and/or the internal dimension may be enlarged. For example, this may be done as the wearer inserts the wearer's foot into the boot when donning the boot and/or when the wearer desires to doff (remove the wearer's foot from) the boot. When the wearer is donning the boot, the lace adjustment mechanism may be configured to the adjustment configuration before or after the wearer inserts the wearer's foot into the boot. After doing so, the adjustment length may be reduced until the fit of the boot upon the wearer's foot is sufficiently secure, or tight, to meet the wearer's preferences and/or the requirements for the wearer's activities while wearing the boot. As discussed, reducing the adjustment length causes the lace to exert a tightening force on the instep pad of the lace adjustment mechanism, which in turn urges the wearer's foot to be seated, or secured, more firmly within the boot's heel region. In the example shown in FIG. 13, the lace adjustment mechanism is not directly secured to the external surface of upper 120, so the lace adjustment mechanism may be slid along the lace until it engages the external surface of the boot's upper at aperture 276. After the wearer is satisfied with the fit of the boot, the wearer may release the head of the plunger, thereby permitting the lace adjustment mechanism to return to the locked configuration and thereby retain the fit adjustment system 200 and boot 100 in the selected configuration, or fit.

FIGS. 14 and 15 provide another example of a boot 100 with a fit adjustment system 200. The internal components of fit adjustment system 200 and boot 100 are not illustrated in FIGS. 14-15, but as discussed, may correspond to the components described and/or illustrated in FIGS. 1-12. In FIG. 14, fit adjustment system 200 includes a lace adjustment mechanism 280 with a lace lock 282 in the form of an adjustment reel 300. FIG. 15 provides an exploded view of an example of adjustment reel 300. Adjustment reel 300 may be positioned at any suitable position and/or location of boot 100. For example, and as discussed, adjustment reel 300 may be operatively coupled to and/or supported by shell 122 or by shaft 124. Additionally or alternatively, adjustment reel 300 may be positioned such that reel housing 302 is fixedly coupled to upper 120 and/or to heel counter 130. In some examples, and as schematically illustrated in FIG. 14 adjustment reel 300 is positioned within heel region 112. However, this is not required of all examples of boot 100, and it additionally is within the scope of the present disclosure that adjustment reel 300 may be positioned at any suitable location that is accessible to the wearer while boot 100 is worn on the wearer's foot, such as a location that is external to heel region 112 on the boot's medial boot side, on the boot's lateral boot side, on shell 122, and/or on shaft 124.

Adjustment reel 300 may include any suitable components or structures for selectively collecting and releasing a length of lace 260, as described herein. For example, and as illustrated in FIG. 15, adjustment reel 300 may include a reel spool 304 that is configured to collect (e.g., support and/or store) the free length of lace 260. When wrapped around reel spool 304, free length 264 additionally or alternatively may be referred to as spooled length 264. Adjustment reel 300 also may include a reel housing 302 that at least partially encloses the reel spool. In such examples, adjustment reel 300 also may include an actuator 292 in the form of a reel dial 306 that is configured to be selectively manipulated by the wearer or other individual proximate boot 100 to selectively configure the fit adjustment system between its adjustment configuration and its locked configuration, and to adjust the length of adjustment length 262 when the lace adjustment system is in the adjustment configuration. For example, urging reel dial 306 away from reel housing 302 configures the lace adjustment mechanism from its locked configuration to its adjustment configuration. When in the adjustment configuration, rotating the reel dial relative to the reel housing adjusts the length of adjustment length 262, such as by increasing or decreasing the portion of lace that is spooled around the reel spool and thus forms free length 264, with the remainder of lace forming adjustment length 262.

In some examples, reel dial 306 is configured to be selectively rotated relative to reel housing 302 in a reel tightening direction to selectively collect portions of the lace onto the reel spool (i.e., reduce the adjustment length of lace 260), and to selectively release portions of the lace from the reel spool (i.e., increase the adjustment length of lace 260) when rotated in the opposite direction. In some examples, adjustment reel 300 further includes a ratchet mechanism 308 that is configured to permit reel dial 306 to be selectively rotated relative to reel housing 302 in the tightening direction when the reel dial is within the reel housing but to restrict the reel dial from rotating relative to the reel housing in a direction opposite the reel tightening direction. In some examples, reel dial 306 also is configured to be selectively rotated relative to reel housing 302 in a reel loosening direction that is opposite the reel tightening direction to selectively release lace 260 from reel spool 304. In other examples, adjustment reel 300 may be configured to selectively release the lace from the reel spool without rotation of the reel dial, such as by selectively disabling and/or circumventing ratchet mechanism 308. Further examples of adjustment reels 300 and/or of components thereof that may be utilized in conjunction with boots 100 and fit adjustment systems 200 according to the present disclosure are disclosed in U.S. Pat. Nos. 7,818,899, 8,087,188, 9,480,299, and 10,492,568, and in U.S. Patent Application Publication Nos. 2008/0168685 and 2016/0058127, the complete disclosures of which are hereby incorporated by reference.

As discussed, boot 100 may be configured such that one or more components of fit adjustment system 200 are at least substantially enclosed within boot 100. For example, instep pad 210 may be positioned beneath or within external surface 114 of upper 120 such that the instep pad is fully concealed by the external surface of the upper. Similarly, lace 260 may be at least substantially enclosed within boot 100, such as by external surface 114 and/or lace adjustment mechanism 280. In this manner, boot 100 may be configured such that instep pad 210 and/or lace 260 is not visible to an end user of the boot, and/or such that the instep pad and/or the lace is not configured to be removed, replaced, repaired, etc. by the end user. Accordingly, the various features and configurations described herein generally are directed to ensuring not only that fit adjustment system 200 operates effectively, but also to ensuring that the components of the fit adjustment system remain operable and resistant to wear over an operational lifetime of the boot. Moreover, it is believed that the structures and configurations disclosed herein represent a minimum number of components for achieving the desired operation and durability, thereby reducing the number of components that may be susceptible to premature degradation and/or failure.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase "at least substantially," when modifying a degree or relationship, includes not only the recited "substantial" degree or relationship, but also the full extent of the recited degree or relationship. A substantial amount of a recited degree or relationship may include at least 75% of the recited degree or relationship. For example, a first direction that is at least substantially parallel to a second direction includes a first direction that is within an angular deviation of 22.5° relative to the second direction and also includes a first direction that is identical to the second direction.

As used herein, the terms "selective" and "selectively," when modifying an action, movement, configuration, or other activity of one or more components or characteristics of an apparatus, mean that the specific action, movement, configuration, or other activity is a direct or indirect result of one or more dynamic processes, as described herein. The terms "selective" and "selectively" thus may characterize an activity that is a direct or indirect result of user manipulation of an aspect of, or one or more components of, the apparatus, or may characterize a process that occurs automatically, such as via the mechanisms disclosed herein.

As used herein, the phrase, "for example," the phrase, "as an example," and/or simply the term "example," when used with reference to one or more components, features, details, structures, and/or embodiments according to the present disclosure, are intended to convey that the described component, feature, detail, structure, and/or embodiment is an illustrative, non-exclusive example of components, features, details, structures, and/or embodiments according to the present disclosure. Thus, the described component, feature, detail, structure, and/or embodiment is not intended to be limiting, required, or exclusive/exhaustive; and other components, features, details, structures, and/or embodiments, including structurally and/or functionally similar and/or equivalent components, features, details, structures, and/or embodiments, are also within the scope of the present disclosure.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

The various disclosed elements of apparatuses and systems and steps of methods disclosed herein are not required to all apparatuses, systems, and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus, system, or method. Accordingly, such inventive subject matter is not required to be associated with the specific apparatuses, systems, and methods that are expressly disclosed herein and such inventive subject matter may find utility in apparatuses, systems, and/or methods that are not expressly disclosed herein.

Illustrative, non-exclusive examples of boots according to the present disclosure are presented in the following enumerated paragraphs:

A1. A boot, comprising:

an upper configured to receive a wearer's foot when the boot is worn by the wearer; wherein the upper includes a shell configured to extend around at least a portion of the wearer's foot when the boot is worn by the wearer and a shaft operatively coupled to the shell and configured to extend around at least a portion of the wearer's lower leg when the boot is worn by the wearer; and further wherein each of the shell and the shaft defines a portion of an external surface of the upper;

a sole assembly operatively coupled to the upper and configured to contact a ground surface; and a fit adjustment system configured to selectively adjust a fit of the boot on the wearer's foot when the boot is worn; wherein the fit adjustment system includes:

an instep pad positioned interior of the external surface of the upper within an instep region of the boot; wherein the instep region is positioned to extend adjacent to an instep of the wearer's foot when the boot is worn by the wearer;

a lace operatively coupled to the instep pad and configured to selectively exert a tightening force on the instep pad; and a lace adjustment mechanism configured to be selectively actuated to adjust an adjustment length of the lace; wherein when the lace adjustment mechanism is selectively actuated to reduce the adjustment length of the lace, the tightening force is exerted by the lace on the instep pad along a lace tightening direction, and optionally wherein the lace tightening direction is directed toward a heel region of the boot.

A2. The boot of paragraph A1, wherein the fit adjustment system is configured such that, when the lace adjustment mechanism is actuated to reduce the adjustment length of the lace while the boot is worn by the wearer, the lace is configured to urge the instep pad toward the instep of the wearer's foot via the tightening force to selectively tighten the boot upon the wearer's foot.

A3. The boot of any of paragraphs A1-A2, wherein the fit adjustment system is configured such that, when the lace adjustment mechanism is selectively actuated to selectively reduce the adjustment length when the boot is worn by the wearer, the lace draws the instep pad toward the heel region to secure a heel of the wearer's foot within the heel region.

A4. The boot of any of paragraphs A1-A3, wherein the lace includes the adjustment length and a free length, and wherein a sum of the free length and the adjustment length remains constant when the lace adjustment mechanism is actuated to adjust the adjustment length.

A5. The boot of paragraph A4, wherein the fit adjustment system further includes a lace terminator; wherein at least a portion of the lace is fixedly coupled to the lace terminator; wherein the adjustment length extends between the lace adjustment mechanism and the lace terminator; wherein the free length extends from the adjustment length; and wherein the fit adjustment system is configured such that, when the lace adjustment mechanism is selectively actuated to selectively reduce the length of the adjustment length, the free length increases in length.

A6. The boot of any of paragraphs A4-A5, wherein the lace is discontinuous and includes an adjustment length end and a free length end that is on an opposite end of the lace than the adjustment length.

A7. The boot of paragraph A6, wherein the adjustment length end is fixedly coupled to the lace terminator, and further wherein the free length end is distal the lace adjustment mechanism relative to the adjustment length end, and optionally wherein the free length end extends external the external surface of the upper.

A8. The boot of any of paragraphs A5-A7, wherein the lace terminator is fixedly coupled to one or more of:

(i) the upper;

(ii) the heel region of the boot; and (iii) and a/the heel counter.

A9. The boot of any of paragraphs A5-A8, wherein the lace terminator is fixedly coupled to the upper at a location that is adjacent to one or both of the heel region and a/the heel counter.

A10. The boot of any of paragraphs A1-A9, wherein the boot is one or more of (i) a pull-on boot;

(ii) free of one or more of, and optionally all of, mechanical fasteners, adjustable fasteners, tied laces, buckles, zippers, and mechanisms for adjusting a fit of the boot upon the wearer's foot other than via the fit adjustment system; and (iii) free of one or more of, and optionally all of, mechanical fasteners, adjustable fasteners, tied laces, buckles, zippers, and mechanisms for constricting the external surface of the upper.

A11. The boot of any of paragraphs A1-A10, wherein the sole assembly includes one or more of:

(i) an insole configured to contact the wearer's foot when the boot is worn by the wearer;

(ii) an outsole configured to contact a ground surface on which the wearer is striding; and (iii) a heel assembly.

A12. The boot of paragraph A11, wherein the outsole at least partially defines the heel assembly.

A13. The boot of paragraph A11, wherein the heel assembly one or more of:

(i) is an external heel assembly that is operatively coupled to the outsole;

(ii) is an external heel assembly that projects from the outsole; and (iii) includes a heel breast that faces toward at least a portion of the sole assembly that extends forward of the heel assembly.

A14. The boot of any of paragraphs A1-A13, wherein the heel region extends around at least a portion of a heel of the wearer's foot when the boot is worn by the wearer.

A15. The boot of any of paragraphs A1-A14, wherein the upper includes a heel counter positioned in the heel region of the boot and configured to reinforce the heel region of the boot.

A16. The boot of paragraph A15, wherein at least a portion of the heel counter is positioned interior of the external surface of the upper.

A17. The boot of any of paragraphs A15-A16, wherein the heel region includes the heel counter and a/the heel assembly.

A18. The boot of any of paragraphs A1-A17, further comprising a medial boot side that extends proximate to a medial side of the wearer's foot when the boot is worn by the wearer, a lateral boot side that extends proximate to a lateral side of the wearer's foot when the boot is worn by the wearer; and wherein the boot defines a midline plane that separates the medial boot side and the lateral boot side and that is coplanar with a sagittal plane of the wearer's foot when the boot is worn by the wearer.

A19. The boot of paragraph A18, wherein the boot defines a sole assembly plane extending perpendicular to the midline plane such that at least a portion of the sole assembly extends within the sole assembly plane; optionally wherein at least a portion of the wearer's foot contacts the sole assembly at the sole assembly plane when the boot is worn by the wearer.

A20. The boot of any of paragraphs A18-A19, wherein the instep pad is configured to be at least substantially centered about the midline plane when the boot is worn by the wearer and the lace adjustment mechanism is actuated to reduce the adjustment length of the lace.

A21. The boot of any of paragraphs A18-A20, wherein a projection of the lace tightening direction onto the midline plane is angled relative to a/the sole assembly plane by a tightening angle; and wherein the tightening angle is one or more of at least 30 degrees, at least 35 degrees, at least 40 degrees, at least 45 degrees, at least 50 degrees, at least 55 degrees, at most 60 degrees, at most 52 degrees, at most 47 degrees, at most 42 degrees, at most 37 degrees, and at most 32 degrees.

A22. The boot of any of paragraphs A18-A21, wherein a/the projection of the lace tightening direction onto the midline plane intersects a/the heel counter.

A23. The boot of any of paragraphs A18-A22, wherein a/the projection of the lace tightening direction onto the midline plane intersects a/the sole assembly plane at a location that is one or more of:

(i) within the heel region;

(ii) exterior of the sole assembly; and (iii) exterior of the boot.

A24. The boot of any of paragraphs A1-A23, wherein the instep pad is fully concealed by the external surface of the upper.

A25. The boot of any of paragraphs A1-A24, wherein the upper further includes a liner positioned interior of the external surface of the upper, and wherein the instep pad is positioned between the external surface and the liner.

A26. The boot of paragraph A25, wherein the liner is configured to contact the wearer's foot when the boot is worn by the wearer.

A27. The boot of any of paragraphs A25-A26, wherein the liner prevents contact between the wearer's foot and one or more of the lace, the instep pad, and the lace adjustment mechanism when the boot is worn by the wearer.

A28. The boot of any of paragraphs A25-A27, wherein the liner prevents contact between the wearer's foot and the fit adjustment system when the boot is worn by the wearer.

A29. The boot of any of paragraphs A25-A28, wherein the shell includes the liner.

A30. The boot of any of paragraphs A25-A29, wherein the liner is formed of a fabric, optionally a waterproof fabric.

A31. The boot of any of paragraphs A1-A30, wherein the lace is at least substantially, and optionally fully, enclosed by one or both of the external surface of the upper and the lace adjustment mechanism.

A32. The boot of any of paragraphs A1-A31, wherein the lace is not configured to be removed and replaced by an end user of the boot.

A33. The boot of any of paragraphs A1-A32, wherein the lace is non-elastic.

A34. The boot of any of paragraphs A1-A33, wherein the lace is formed from one or more of metal, nylon, fabric, and plastic.

A35. The boot of any of paragraphs A1-A34, wherein the instep pad includes an adjustment end and an anchor end; wherein the lace is operatively and adjustably coupled to the adjustment end.

A36. The boot of paragraph A35, wherein the lace does not engage the anchor end of the instep pad.

A37. The boot of any of paragraphs A35-A36, wherein the fit adjustment system further includes an anchor strap that is fixedly coupled to a strap anchor location of the boot.

A38. The boot of paragraph A37, wherein the strap anchor location of the boot includes the anchor end of the instep pad.

A39. The boot of paragraph A37, wherein the instep pad includes the anchor strap.

A40. The boot of paragraph A39, wherein the anchor end of the instep pad is fixedly coupled to the strap anchor location.

A41. The boot of any of paragraphs A35-A40, wherein the adjustment end is positioned within a/the medial boot side, and wherein the anchor end is positioned within a/the lateral boot side.

A42. The boot of any of paragraphs A35-A41, wherein the instep pad includes an anterior edge and a posterior edge; wherein each of the anterior edge and the posterior edge extends between the adjustment end and the anchor end.

A43. The boot of any of paragraphs A37-A42, wherein the anchor strap includes, and optionally is, one or more of a strap, a webbing, a belt, a cord, and a band.

A44. The boot of any of paragraphs A37-A43, wherein the anchor strap is flexible.

A45. The boot of any of paragraphs A37-A44, wherein one or both of the instep pad and the anchor strap is/are not configured to stretch during operative use of the fit adjustment system.

A46. The boot of any of paragraphs A37-A45, wherein the anchor strap is fixedly coupled to the instep pad via stitching, optionally via one or both of box stitching and reinforced stitching.

A47. The boot of any of paragraphs A37-A46, wherein the strap anchor location is positioned within the heel region of the boot.

A48. The boot of any of paragraphs A37-A46, wherein the strap anchor location is positioned adjacent to the heel region of the boot.

A49. The boot of any of paragraphs A37-A48, wherein the upper includes the strap anchor location.

A50. The boot of any of paragraphs A37-A49, wherein a/the heel counter includes the strap anchor location.

A51. The boot of any of paragraphs A37-A48, wherein the sole assembly includes the strap anchor location.

A52. The boot of any of paragraphs A1-A51, wherein the instep pad, and optionally a/the adjustment end of the instep pad, includes an instep pad lace channel; wherein the lace extends through the instep pad lace channel; and wherein, when the lace adjustment mechanism is selectively actuated to selectively reduce the adjustment length, the portion of the lace extending through the instep pad lace channel exerts the tightening force on the instep pad, and optionally the adjustment end of the instep pad, along the lace tightening direction.

A53. The boot of any of paragraphs A1-A52, wherein one or both of an/the anterior edge and a/the posterior edge of the instep pad defines one or more compliance notches configured to facilitate conforming of the instep pad to the wearer's foot.

A54. The boot of paragraph A53, wherein the compliance notches are configured to permit the instep pad to conform to the wearer's foot without producing wrinkles or folds in the instep pad.

A55. The boot of any of paragraphs A1-A54, wherein the instep pad has an instep pad width, as measured between an/the adjustment end and an/the anchor end; wherein the instep pad has an instep pad length, as measured between an/the anterior edge and a/the posterior edge; and wherein the instep pad width is greater than the instep pad length.

A56. The boot of paragraph A55, wherein a ratio of the instep pad width to the instep pad length is one or more of at least 1.5:1, at least 2:1, at least 2.5:1, at least 3:1, at least 3.5:1, at least 4:1, at most 4.5:1, at most 3.7:1, at most 3.2:1, at most 2.7:1, at most 2.2:1, and at most 1.7:1.

A57. The boot of any of paragraphs A55-A56, wherein the instep pad is flexible; and wherein each of the instep pad width and the instep pad length is measured when the instep pad is flexed to a configuration that is at least substantially planar.

A58. The boot of any of paragraphs A1-A57, wherein the instep pad further includes a structural layer.

A59. The boot of paragraph A58, wherein the structural layer is formed of one or more of a nylon, a leather, a plastic, a thermoplastic, and thermoplastic polyurethane.

A60. The boot of any of paragraphs A1-A59, wherein the instep pad further includes a cushioning layer that is configured to resiliently compress to conform to the wearer's foot when the boot is worn by the wearer.

A61. The boot of paragraph A60, wherein the cushioning layer is formed of one or more of a foam, an open-cell foam, polyurethane, and ethylene-vinyl acetate (EVA).

A62. The boot of any of paragraphs A60-A61, when dependent from any of paragraphs A58-A59, wherein the structural layer is operatively coupled to the cushioning layer; wherein the cushioning layer is positioned proximate to the wearer's foot relative to the structural layer when the boot is worn by the wearer.

A63. The boot of any of paragraphs A60-A62, when dependent from any of paragraphs A58-A59, wherein the structural layer is formed of a material that is less compliant than the cushioning layer.

A64. The boot of any of paragraphs A60-A63, when dependent from any of paragraphs A58-A59, wherein the structural layer and the cushioning layer are at least substantially coextensive with one another.

A65. The boot of any of paragraphs A60-A64, when dependent from any of paragraphs A58-A59, wherein the structural layer and the cushioning layer are operatively coupled to one another via one or more of mechanical fastening, stitching, an adhesive, and co-molding.

A66. The boot of any of paragraphs A1-A65, wherein the lace adjustment mechanism includes a lace lock configured to selectively engage the lace to define the adjustment length of the lace and a/the free length of the lace.

A67. The boot of paragraph A66, wherein the lace lock includes a clamp.

A68. The boot of any of paragraphs A66-A67, wherein the lace adjustment mechanism is selectively configured between an adjustment configuration, in which the lace lock permits adjustment of the adjustment length of the lace, and a locked configuration, in which the lace lock restricts adjustment of the adjustment length of the lace.

A69. The boot of paragraph A68, wherein the lace adjustment mechanism includes an actuator configured to be manipulated by the wearer to selectively configure the lace adjustment mechanism from the locked configuration to the adjustment configuration.

A70. The boot of any of paragraphs A68-A69, wherein the lace lock is biased to the locked configuration.

A71. The boot of any of paragraphs A69-A70, wherein at least a portion of, and optionally all of, the actuator extends external the external surface of the upper.

A72. The boot of any of paragraphs A69-A71, wherein the actuator is configured to be manipulated by the wearer to selectively configure the lace adjustment mechanism between the adjustment configuration and the locked configuration.

A73. The boot of any of paragraphs A1-A72, wherein at least a portion of, and optionally all of, the lace adjustment mechanism extends external the external surface of the upper.

A74. The boot of any of paragraphs A1-A73, wherein the external surface of the upper includes an aperture, and wherein the lace extends through the aperture.

A75. The boot of any of paragraphs A66-A74, wherein the lace lock includes an adjustment reel.

A76. The boot of paragraph A75, wherein the adjustment reel includes:

a reel spool configured to collect the free length of the lace;

a reel housing that at least partially encloses the reel spool; and a reel dial configured to be selectively actuated by the wearer to selectively collect the free length of the lace onto the reel spool as the adjustment length is decreased and to selectively release the free length of the lace from the reel spool as the adjustment length is increased.

A77. The boot of paragraph A76, wherein the reel dial is configured to be selectively rotated relative to the reel housing in a reel tightening direction to selectively collect the free length of the lace onto the reel spool.

A78. The boot of paragraph A77, wherein the adjustment reel includes a ratchet mechanism configured to permit the reel dial to be selectively rotated relative to the reel housing in the reel tightening direction and to selectively restrict the reel dial from rotating relative to the reel housing in a direction opposite the reel tightening direction.

A79. The boot of any of paragraphs A77-A78, wherein the reel dial is configured to be selectively rotated relative to the reel housing in a reel loosening direction, which is opposite the reel tightening direction, to selectively release the free length of the lace from the reel spool.

A80. The boot of any of paragraphs A76-A79, wherein the adjustment reel is positioned within the heel region of the boot.

A81. The boot of any of paragraphs A76-A80, wherein the reel housing is fixedly coupled to one or both of the upper and a/the heel counter.

A82. The boot of any of paragraphs A76-A81, wherein the adjustment reel is supported by the shaft of the boot.

A83. The boot of any of paragraphs A75-A82, wherein the adjustment reel is supported by the shell of the boot.

A84. The boot of any of paragraphs A75-A83, wherein at least a portion of, and optionally at least a substantial portion or all of, the adjustment reel extends external the external surface of the upper.

A85. The boot of any of paragraphs A1-A84, wherein the fit adjustment system further includes a lace guide; and wherein the lace extends between a/the lace terminator and the lace adjustment mechanism via the lace guide.

A86. The boot of paragraph A85, wherein the lace guide is configured to support and/or guide the lace relative to the upper.

A87. The boot of any of paragraphs A85-A86, wherein the lace guide is configured to slidingly engage the lace as the lace adjustment mechanism is selectively actuated to selectively adjust the adjustment length of the lace.

A88. The boot of any of paragraphs A85-A87, wherein the lace guide includes, and optionally is, one or more of a groove, a channel, a tunnel, and a hook.

A89. The boot of any of paragraphs A85-A88, wherein the lace extends between the lace guide and the lace terminator via an/the adjustment end of the instep pad, optionally via an/the instep pad lace channel of the adjustment end.

A90. The boot of any of paragraphs A85-A89, wherein one or both of the lace guide and the lace terminator is configured to direct the lace at least partially toward the adjustment end of the instep pad.

A91. The boot of any of paragraphs A85-A90, wherein one or both of the lace guide and the lace terminator is fixedly coupled to the upper.

A92. The boot of any of paragraphs A85-A91, wherein one or both of the lace guide and the lace terminator is fixedly coupled to the heel region of the boot; optionally to a/the heel counter.

A93. The boot of any of paragraphs A85-A92, wherein one or both of the lace guide and the lace terminator is fixedly coupled to the upper at a location that is adjacent to one or both of the heel region and a/the heel counter.

A94. The boot of any of paragraphs A85-A93, wherein the fit adjustment system further includes a lace conduit configured to enclose at least a portion of the lace between the lace adjustment mechanism and the lace guide.

A95. The boot of paragraph A94, wherein the lace conduit terminates at the lace guide.

A96. The boot of any of paragraphs A94-A95, wherein the lace conduit is configured to support and/or guide the lace relative to the upper.

A97. The boot of any of paragraphs A94-A96, wherein the lace conduit is configured to slidingly engage the lace as the lace adjustment mechanism is selectively actuated to selectively adjust the adjustment length of the lace.

A98. The boot of any of paragraphs A94-A97, wherein the lace conduit is fixedly coupled to one or both of the upper and a/the heel counter.

A99. The boot of any of paragraphs A1-A98, wherein at least a portion of the fit adjustment system is enclosed by a/the heel counter.

A100. The boot of paragraph A99, wherein the heel counter includes an inner heel counter layer and an outer heel counter layer; and wherein at least a portion of the fit adjustment system is positioned between the inner heel counter layer and the outer heel counter layer.

A101. The boot of paragraph A99, wherein the heel counter includes an inner heel counter layer and an outer heel counter layer; and wherein one or more of a/the lace guide, a/the lace terminator, a/the strap anchor location, a/the lace conduit, and the lace adjustment mechanism is at least partially positioned between the inner heel counter layer and the outer heel counter layer.

INDUSTRIAL APPLICABILITY

The boots disclosed herein are applicable to the footwear industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, when the disclosure, the preceding numbered paragraphs, or subsequently filed claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

The invention claimed is:

1. A boot, comprising:

an upper configured to receive a foot of a wearer when the boot is worn by the wearer; wherein the upper includes a shell configured to extend around at least a portion of the wearer's foot when the boot is worn by the wearer and a shaft operatively coupled to the shell and configured to extend around at least a portion of the wearer's lower leg wherein the shaft is configured to extend from the wearer's foot to at least proximate a mid-calf region of the wearer's leg when the boot is worn by the wearer; and further wherein each of the shell and the shaft defines a portion of an external surface of the upper;

a sole assembly operatively coupled to the upper and configured to contact a ground surface; and a fit adjustment system configured to selectively adjust a fit of the boot on the wearer's foot when the boot is worn; wherein the fit adjustment system includes:

an instep pad positioned interior of the external surface of the upper within an instep region of the boot; wherein the instep region is positioned to extend adjacent to an instep of the wearer's foot when the boot is worn by the wearer;

a lace operatively coupled to the instep pad and configured to selectively exert a tightening force on the instep pad; and wherein the lace is discontinuous and includes an adjustment length end and a free length end that is on an opposite end of the lace than the adjustment length end;

a lace adjustment mechanism configured to be selectively actuated to adjust an adjustment length of the lace; wherein when the lace adjustment mechanism is selectively actuated to reduce the adjustment length of the lace, the tightening force is exerted by the lace on the instep pad along a lace tightening direction, and wherein the lace tightening direction is directed toward a heel region of the boot; and a lace terminator; wherein at least a portion of the lace is fixedly coupled to the lace terminator; wherein the adjustment length extends between the lace adjustment mechanism and the lace terminator; wherein a free length of the lace extends from the adjustment length; wherein the fit adjustment system is configured such that, when the lace adjustment mechanism is selectively actuated to selectively reduce the length of the adjustment length, the free length increases in length; wherein the adjustment length end is fixedly coupled to the lace terminator, and further wherein the lace terminator is fixedly coupled to a heel counter of the boot.

2. The boot of claim 1, wherein the boot defines a midline plane that separates a medial boot side and a lateral boot side and that is coplanar with a sagittal plane of the wearer's foot when the boot is worn by the wearer; wherein the boot defines a sole assembly plane extending perpendicular to the midline plane such that at least a portion of the sole assembly extends within the sole assembly plane; wherein a projection of the lace tightening direction onto the midline plane is angled relative to the sole assembly plane by a tightening angle; and further wherein the tightening angle is at least 30 degrees and at most 60 degrees.

3. The boot of claim 2, wherein the boot includes a heel counter; and further wherein the projection of the lace tightening direction onto the midline plane intersects the heel counter of the boot.

4. The boot of claim 2, wherein the projection of the lace tightening direction onto the midline plane intersects the sole assembly plane at a location that is exterior of the sole assembly.

5. The boot of claim 1, wherein the upper further includes a liner positioned interior of the external surface of the upper; wherein the instep pad is positioned between the external surface and the liner, and wherein the liner is configured to provide a physical barrier between the wearer's foot and the fit adjustment system when the boot is worn by the wearer.

6. The boot of claim 1, wherein the lace is enclosed by one or both of the external surface of the upper and the lace adjustment mechanism.

7. The boot of claim 1, wherein the instep pad includes an adjustment end and an anchor end; wherein the lace is operatively and adjustably coupled to the adjustment end; and wherein the lace does not engage the anchor end of the instep pad.

8. The boot of claim 1, wherein the fit adjustment system further includes an anchor strap that is fixedly coupled to an anchor end of the instep pad and the heel region of the boot.

9. The boot of claim 8, wherein the anchor strap is fixedly coupled to an anchor end of the instep pad and a heel counter of the heel region of the boot.

10. The boot of claim 1, wherein one or both of an anterior edge and a posterior edge of the instep pad defines one or more compliance notches configured to facilitate conforming of the instep pad to the wearer's foot without producing wrinkles or folds in the instep pad.

11. The boot of claim 1, wherein the instep pad further includes a cushioning layer that is configured to resiliently compress to conform to the wearer's foot when the boot is worn by the wearer and a structural layer that is formed of a material that is less compliant than the cushioning layer; and further wherein the instep pad is configured not to stretch during operative use of the fit adjustment system.

12. The boot of claim 1, wherein the lace adjustment mechanism includes a lace lock configured to selectively engage the lace to define the adjustment length of the lace and a free length of the lace; and wherein the lace lock includes at least one of:

(i) an adjustment reel; and (ii) a spring-biased plunger.

13. The boot of claim 12, wherein the lace adjustment mechanism includes an actuator configured to be manipulated by the wearer to selectively configure the lace adjustment mechanism from a locked configuration, in which the lace lock restricts adjustment of the adjustment length of the lace, to an adjustment configuration, in which the lace lock permits adjustment of the adjustment length of the lace; and wherein the actuator extends external the external surface of the upper.

14. The boot of claim 1, wherein the fit adjustment system further includes a lace guide; and wherein the lace extends between the lace terminator and the lace adjustment mechanism via the lace guide.

15. The boot of claim 1, wherein the heel region of the boot includes a heel counter; wherein the heel counter includes an inner heel counter layer and an outer heel counter layer; wherein at least a portion of the fit adjustment system is positioned between the inner heel counter layer and the outer heel counter layer.

16. The boot of claim 1, wherein the boot is a pull-on boot that is one or more of:

(i) free of mechanical fasteners, adjustable fasteners, tied laces, buckles, zippers, and mechanisms for adjusting the fit of the boot upon the wearer's foot other than via the fit adjustment system; and (ii) free of mechanical fasteners, adjustable fasteners, tied laces, buckles, zippers, and mechanisms for constricting the external surface of the upper.

17. The boot of claim 1, wherein the heel region includes an external heel that projects from an outsole of the sole assembly in the heel region of the boot.

18. The boot of claim 1, wherein when the boot is worn, the fit adjustment system is configured to adjust the fit of the boot on the wearer's foot without constricting an external perimeter surface of the upper of the boot.

* * * * *